US008726540B2

(12) United States Patent
Crowley, II et al.

(10) Patent No.: US 8,726,540 B2
(45) **Date of Patent: *May 20, 2014**

(54) FOOTWEAR

(75) Inventors: Kevin Crowley, II, Newbury, MA (US); David M. Nau, Wayland, MA (US); James Cheney, Northboro, MA (US); Nicholas W. Wong, Lexington, MA (US)

(73) Assignee: SR Holdings, LLC, Lexington, MA (US)

( * ) Notice: Subject to any disclaimer, the term of this patent is extended or adjusted under 35 U.S.C. 154(b) by 233 days.

This patent is subject to a terminal disclaimer.

(21) Appl. No.: 13/107,235

(22) Filed: May 13, 2011

(65) Prior Publication Data

US 2012/0180340 A1 Jul. 19, 2012

Related U.S. Application Data

(60) Provisional application No. 61/432,317, filed on Jan. 13, 2011.

(51) Int. Cl.

| | |
|---|---|
| ***A43B 13/14*** | (2006.01) |
| ***A43B 23/24*** | (2006.01) |
| ***A43B 23/00*** | (2006.01) |
| ***A43B 5/08*** | (2006.01) |
| ***A43B 1/00*** | (2006.01) |
| *A43B 23/02* | (2006.01) |
| *A43B 13/22* | (2006.01) |

(52) U.S. Cl.

CPC ..... *A43B 1/0009* (2013.01); *A43B 5/08* (2013.01); *A43B 23/0225* (2013.01); *A43B 13/223* (2013.01)

USPC ..... 36/8.1; 36/45; 36/103

(58) Field of Classification Search

CPC .. A43B 1/0009; A43B 1/0027; A43B 13/223; A43B 5/08; A43B 5/00; A43B 23/0205; A43B 23/0225; A43B 23/0245; A43B 23/026; A43B 23/0295

USPC ..... 36/45, 4, 3 A, 7.3, 114, 102, 103, 8.1; D2/969, 972

See application file for complete search history.

(56) References Cited

U.S. PATENT DOCUMENTS

| | | | | |
|---|---|---|---|---|
| 1,725,347 | A * | 8/1929 | Glidden et al. | 36/4 |
| 2,129,226 | A * | 9/1938 | Montano | 36/8.1 |
| 3,191,321 | A | 6/1965 | Brutting | |

(Continued)

FOREIGN PATENT DOCUMENTS

| | | |
|---|---|---|
| CN | 2629486 Y | 8/2004 |
| DE | 2255628 A1 | 5/1974 |

(Continued)

OTHER PUBLICATIONS

International Search Report for Application PCT/US2011/052936 dated Feb. 21, 2012.

(Continued)

*Primary Examiner* — Jila M Mohandesi

(74) *Attorney, Agent, or Firm* — Warner Norcross & Judd LLP

(57) ABSTRACT

A footwear upper including a first layer and a second layer disposed on the first layer exteriorly of the first layer. The second layer defines grooves in a rhombille tiling pattern.

56 Claims, 35 Drawing Sheets

(56) References Cited

U.S. PATENT DOCUMENTS

| | | | | | |
|---|---|---|---|---|---|
| 3,370,363 | A | * | 2/1968 | Kaplan | 36/9 R |
| 3,525,165 | A | | 8/1970 | Randall, Jr. | |
| 4,103,439 | A | * | 8/1978 | Abramson | 36/7.3 |
| D250,617 | S | | 12/1978 | Noches | |
| 4,716,663 | A | | 1/1988 | Steinhauser | |
| 4,858,339 | A | * | 8/1989 | Hayafuchi et al. | 36/45 |
| 5,913,592 | A | * | 6/1999 | Moore | 36/8.1 |
| 6,038,792 | A | | 3/2000 | Hauter | |
| D424,798 | S | * | 5/2000 | McDowell | D2/972 |
| D431,351 | S | | 10/2000 | Prats et al. | |
| D461,628 | S | * | 8/2002 | Neely et al. | D2/972 |
| D465,320 | S | | 11/2002 | Weege | |
| 6,523,282 | B1 | | 2/2003 | Johnston | |
| 6,681,503 | B2 | | 1/2004 | Morle | |
| D508,308 | S | | 8/2005 | Galway | |
| 7,047,668 | B2 | | 5/2006 | Burris et al. | |
| D523,624 | S | | 6/2006 | Kuerbis | |
| D579,186 | S | * | 10/2008 | Mervar et al. | D2/969 |
| 7,487,605 | B2 | | 2/2009 | Hatzilias | |
| 7,562,471 | B2 | | 7/2009 | Minami | |
| D602,235 | S | | 10/2009 | Hatzilias | |
| 7,650,703 | B2 | * | 1/2010 | Conolly | 36/8.1 |
| 7,793,434 | B2 | | 9/2010 | Sokolowski et al. | |
| 7,913,420 | B2 | * | 3/2011 | Arizumi | 36/3 A |
| 7,930,841 | B2 | * | 4/2011 | Luedecke et al. | 36/113 |
| 7,941,946 | B2 | * | 5/2011 | Clancy et al. | 36/113 |
| 8,196,322 | B2 | * | 6/2012 | Atsumi et al. | 36/133 |
| D663,519 | S | * | 7/2012 | Grangaard | D2/969 |
| 2003/0167658 | A1 | | 9/2003 | Davis | |
| 2004/0055183 | A1 | | 3/2004 | Lee et al. | |
| 2004/0211090 | A1 | * | 10/2004 | Miller et al. | 36/97 |
| 2005/0144812 | A1 | | 7/2005 | Wheeler | |
| 2006/0174520 | A1 | | 8/2006 | Wu | |
| 2007/0204481 | A1 | * | 9/2007 | Conolly | 36/8.1 |
| 2009/0113766 | A1 | | 5/2009 | Hooper | |
| 2010/0107449 | A1 | | 5/2010 | Minami | |
| 2010/0299967 | A1 | | 12/2010 | Atsumi et al. | |
| 2010/0331122 | A1 | | 12/2010 | Morag | |
| 2011/0035963 | A1 | * | 2/2011 | Baker et al. | 36/114 |

FOREIGN PATENT DOCUMENTS

| | | | |
|---|---|---|---|
| DE | 2743666 | A1 | 3/1978 |
| DE | 2801984 | A1 | 7/1979 |
| DE | 2827172 | A1 | 1/1980 |
| DE | 3314274 | A1 | 10/1983 |
| EP | 0383489 | | 8/1990 |
| EP | 0496931 | A1 | 8/1992 |
| EP | 0948269 | A1 | 10/1999 |
| EP | 1430801 | A1 | 6/2004 |
| ES | 2088365 | A1 | 8/1996 |
| FR | 825095 | A | 2/1938 |
| FR | 2475369 | A1 | 8/1981 |
| GB | 6995 | | 0/1901 |
| GB | 7669 | | 0/1905 |
| GB | 202859 | A | 8/1923 |
| GB | 409010 | A | 4/1934 |
| GB | 735712 | A | 8/1955 |
| GB | 940925 | A | 11/1963 |
| GB | 2248171 | A | 4/1992 |
| GB | 2259639 | A | 3/1993 |
| GB | 2286517 | A | 8/1995 |
| GB | 2361406 | A | 10/2001 |
| GB | 2430859 | A | 4/2007 |
| RU | 2015675 | C1 | 7/1994 |
| WO | WO-9305673 | A1 | 4/1993 |
| WO | WO-9632856 | A2 | 10/1996 |
| WO | WO-9816129 | A1 | 4/1998 |
| WO | WO-9825490 | A1 | 6/1998 |
| WO | WO-2006050565 | A1 | 5/2006 |
| WO | 2007144331 | | 12/2007 |
| WO | WO-2010138315 | A2 | 12/2010 |

OTHER PUBLICATIONS

PCT/US2011/062936, Written Opinion, Jan. 4, 2013.

International Search Report for application PCT/US2011/052918 dated Apr. 4, 2012.

* cited by examiner

FOOTWEAR

CROSS REFERENCE TO RELATED APPLICATIONS

This U.S. patent application claims priority under 35 U.S.C. §119(e) to U.S. Provisional Application 61/432,317, filed on Jan. 13, 2011, which is hereby incorporated by reference in its entirety.

TECHNICAL FIELD

This disclosure relates to footwear.

BACKGROUND

Articles of footwear, such as shoes, are generally worn while exercising to protect and provide stability of a user's feet. In general, shoes include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability while shape, texture, and color are used to promote the aesthetic qualities of the shoe. The sole generally provides support for a user's foot and acts as an interface between the user's foot and the ground.

SUMMARY

One aspect of the disclosure provides a footwear upper including a first layer and a second layer disposed on the first layer exteriorly of the first layer. The second layer defines grooves in a rhombille tiling pattern.

Implementations of the disclosure may include one or more of the following features. In some implementations, the second layer is disposed on at least one of a top forefoot portion, a heel portion, a lateral portion, and a medial portion of the first layer. The rhombille tiling may be a tessellation of 60° rhombi. Moreover, the rhombille tiling pattern may include a hexagonal tiling of overlapping hexagonally shaped figures. Each figure is divided into three rhombi meeting at a center point of the hexagonally shaped figure. First and second diagonals of each rhombus may have a ratio of 1:√3.

In some examples, the grooves are defined to provide an edge density of between about 40 mm/cm2 and about 200 mm/cm2 and a surface contact ratio of between about 40% and about 95%. The first layer may comprise polychloroprene. The second layer may comprise rubber. In some instances, the second layer has durometer between about 35 Shore A and about 70 Shore A and/or a thickness of between about 1 mm and about 1.5 cm.

Another aspect of the disclosure provides a footwear article that includes a sole assembly and an upper assembly attached to the sole assembly. The upper assembly includes a first layer and a second layer disposed on the first layer exteriorly of the first layer. The second layer defines grooves in a rhombille tiling pattern.

In some implementations, the second layer is disposed on at least one of a top forefoot portion, a heel portion, a lateral portion, and a medial portion of the first layer. The rhombille tiling may be a tessellation of 60° rhombi. Moreover, the rhombille tiling pattern may include a hexagonal tiling of overlapping hexagonally shaped figures. Each figure is divided into three rhombi meeting at a center point of the hexagonally shaped figure. First and second diagonals of each rhombus may have a ratio of 1:√3.

In some examples, the grooves are defined to provide an edge density of between about 40 mm/cm2 and about 200 min/cm2 and a surface contact ratio of between about 40% and about 95%. The first layer may comprise polychloroprene. The second layer may comprise rubber. In some instances, the second layer has durometer of between about 35 Shore A and about 70 Shore A and/or a thickness of between about 1 mm and about 1.5 cm. A third layer may be disposed between the first and second layers. The third layer includes a compliant material for cushioning.

One aspect of the disclosure provides an outsole (e.g., as part of a sole assembly) for an article of footwear. The outsole includes an outsole body having a ground contact surface and defining grooves having a sinusoidal path along the ground contact surface. The grooves are arranged to provide an edge density of between about 40 mm/cm$^2$ and about 200 mm/cm$^2$ and a surface contact ratio of between about 40% and about 95%.

Implementations of the disclosure may include one or more of the following features. In some implementations, at least some of the sinusoidal grooves are arranged substantially parallel to each other to provide an edge density of about 59 mm/cm$^2$ and a surface contact ratio of about 67%. In additional implementations, at least some of the sinusoidal grooves are arranged substantially parallel to each other to provide an edge dens: of about 106 mm/cm$^2$ and a surface contact ratio of about 91%. In yet additional implementations, at least some of the sinusoidal grooves are arranged substantially parallel to each other to provide an edge density of about 80 mm/cm$^2$ and a surface contact ratio of about 84%. At least some of the sinusoidal grooves, in some implementations, are arranged substantially parallel to each other to provide an edge density of about 77 mm/cm$^2$ and a surface contact ratio of about 90%.

At least one sinusoidal groove path along the ground contact surface may have is an amplitude of between about 3 mm and about 25 mm and/or a frequency of between about 4 mm and about 50 mm. For example, at least one sinusoidal groove path along the ground contact surface may have an amplitude of between about 5 mm and a frequency of about 6.3 mm. Moreover, the corresponding groove may have a width of between about 0.1 mm and about 5 mm and/or a depth of between about 25% a thickness of the outsole and about 75% the thickness of the outsole. For example, the corresponding groove may have a width of about 0.4 mm and/or a depth of about 1.2 mm.

In some implementations, each groove has a sinusoidal groove path along the ground contact surface having an amplitude of about 5 mm and a frequency of about 6.3 mm. Adjacent grooves are offset from each other along the ground contact surface in a common direction by an offset distance of about 3.15 mm. At least one channel may connect two adjacent grooves. The at least one channel can have a depth of about half a depth of the grooves and/or a width substantially equal to a width of the grooves.

In additional implementations, at least one sinusoidal groove path along the ground contact surface has an amplitude of about 17.6 mm and a frequency of about 40 mm. The corresponding groove may have a width of about 1 mm and/or a depth of about 1.5 mm.

Each groove may have a sinusoidal groove path along the ground contact surface having an amplitude of about 17.6 mm and a frequency of about 40 mm, where adjacent grooves are offset from each other along the ground contact surface in a common direction by an offset distance of between about 3 mm and about 3.75 mm. For three consecutive grooves along the ground contact surface, a first groove may be offset from a second groove by an offset distance of about 3 mm and the second groove may be offset from a third groove by an offset distance of about 3.75 mm.

Each groove may have at least one shoulder edge with the ground contact surface. The at least one shoulder edge may define a right angle with a substantially non-radiused corner. Other shoulder edge configurations are possible as well, such as rounded, chamfered, etc.

The outsole body may comprise at least one of rubber having a durometer is between about 45 Shore A and about 65 Shore A, a rubber having a minimum coefficient of friction of about 0.9 and a durometer of between about 50 Shore A and about 65 Shore A, and a rubber having a minimum coefficient of friction of about 1.1 and a durometer of between about 50 Shore A and about 65 Shore A.

Another aspect of the disclosure provides an outsole for an article of footwear that includes an outsole body having a ground contact surface and defining grooves having a sinusoidal path along the ground contact surface. The grooves define a sinusoidal groove path along the ground contact surface having an amplitude of about 5 mm and a frequency of about 6.3 mm.

In some implementations, the grooves have a width of about 0.4 mm and/or a depth of about 1.2 mm. Adjacent grooves may be offset from each other along the ground contact surface in a common direction by an offset distance (e.g., about 3.15 mm). In some examples, the outsole includes at least one channel connecting the adjacent grooves. The at least one channel may have a depth of about half a depth of the grooves and/or a width substantially equal to a width of the grooves. Moreover, the grooves may be arranged substantially parallel to each other to provide an edge density of about 106 mm/cm$^2$ and a surface contact ratio of about 91%.

In another aspect, an outsole for an article of footwear includes an outsole body having a ground contact surface and defining grooves having a sinusoidal path along the ground contact surface. The grooves define a sinusoidal groove path along the ground contact surface having an amplitude of about 17.6 mm and a frequency of about 40 mm.

In some implementations, the grooves have a width of about 1 mm and/or a depth of about 1.5 mm. Adjacent grooves my be offset from each other along the ground contact surface in a common direction by an offset distance (e.g., between about 3 mm and about 3.75 mm). For example, for three consecutive grooves along the ground contact surface, a first groove may be offset from a second groove by an offset distance of about 3 mm and the second groove is offset from the third groove by an offset distance of about 3.75 mm.

Each groove may have at least one shoulder edge with the ground contact surface. The at least one shoulder edge may define a right angle with a substantially non-radiused corner. Moreover, at least some adjacent grooves may intersect each other periodically along their respective sinusoidal paths. The grooves can be arranged substantially parallel to each other to provide an edge density of about 59 mm/cm$^2$ and a surface contact ratio of about 67%.

In yet another aspect, an outsole for an article of footwear includes an outsole body having lateral and medial portions and aground contact surface. The outsole defining a longitudinal axis along a walking direction and perpendicular transverse axis. The ground contact surface has a first tread region disposed on the lateral outsole body portion near a lateral periphery of the outsole, a second tread region disposed on the medial outsole body portion neuro medial periphery of the outsole, and a third tread region disposed between the first and second tread regions in at least a ground striking portion of the outsole. The first and second tread regions define grooves having a sinusoidal path along the ground contact surface with an axis of propagation substantially parallel to the longitudinal axis of the outsole. Adjacent grooves are offset from each other along the transverse axis by a first offset distance. The third tread region defines grooves having a sinusoidal path along the ground contact surface with an axis of propagation substantially parallel to the transverse axis of the outsole. Adjacent grooves are offset from each other along the longitudinal axis by a second offset distance.

In some implementations, the grooves of the first and second tread regions define a sinusoidal groove path along the ground contact surface having an amplitude of about 17.6 mm and a frequency of about 40 mm. The grooves of the first and second tread regions may have a width of about 1 mm and/or a depth of about 1.5 mm. The first offset distance may be between about 3 mm and about 3.75 mm. For example, for three consecutive grooves along the ground contact surface of the first and second tread regions, a first groove is offset from a second groove by an offset distance of about 3 mm and the second groove is offset from a third groove by an offset distance of about 3.75 mm. At least some adjacent grooves of the first and second tread regions may intersect each other periodically along their respective sinusoidal paths. Moreover, the grooves the first and second tread regions may be arranged to provide an edge density of about 59 mm/cm$^2$ and a surface contact ratio of about 67%.

The grooves of the third tread region may define a sinusoidal groove path along the ground contact surface having an amplitude of about 5 mm and a frequency of about 6.3 mm. In some examples, the grooves of the third tread region have a width of about 0.4 mm and/or a depth of about 1.2 mm. The second offset distance may be about 3.15 mm. The third tread region sometimes includes at least one channel connecting adjacent grooves. The at least one channel has a depth of about half a depth of the grooves of the third tread region and/or a width substantially equal to a width of the grooves the third tread region. The grooves of the third tread region can be arranged to provide an edge density of about 106 mm/cm$^2$ and a surface contact ratio of about 91%.

Each groove may have at least one shoulder edge with the ground contact surface. The at least one shoulder edge defines a right angle with a substantially non-radiused corner.

For each of the aspects discussed, the outsole body may comprise at least one of rubber having a durometer of between about 45 Shore A and about 65 Shore A, a rubber having a minimum coefficient of friction of about 0.9 and a durometer of between about 50 Shore A and about 65 Shore A, and a rubber having a minimum coefficient of friction of about 1.1 and a durometer of between about 50 Shore A and about 65 Shore A.

In yet another aspect, a footwear upper includes a first layer and a second layer disposed on the first layer exteriorly of the first layer. The second layer defines grooves arranged to have edge density of between about 40 mm/cm2 and about 200 mm/cm2 and a surface contact ratio of between about 40% and about 95%. Each groove has a width of between about 0.1 mm and about 2.5 mm.

In some implementations, the second layer is disposed on at least one of a top forefoot portion, a heel portion, a lateral portion, and a medial portion of the first layer. The grooves may be arranged in a in a rhombille tiling pattern comprising a tessellation of 60° rhombi. Moreover, the rhombille tiling pattern my include a hexagonal tiling of overlapping hexagonally shaped figures. Each figure is divided into three rhombi meeting at a center point of the hexagonally shaped figure. First and second diagonals of each rhombus may have a ratio of 1:√3.

In some implementations, the grooves are defined to have a sinusoidal path. For example, at least one sinusoidal groove path may have an amplitude of between about 3 mm and about 25 mm and/or a frequency of between about 4 mm and about 50 mm, such as an amplitude of about 5 mm and a frequency of about 6.3 mm or an amplitude of about 17.6 mm and a frequency of about 40 mm. Each groove may have at least one shoulder edge. The at least one shoulder edge defines a right angle with a substantially non-radiused corner.

The details of one or more implementations of the disclosure are set forth in the accompanying drawings and the description below. Other aspects, features, and advantages will be apparent from the description and drawings, and from the claims.

Figure 1:
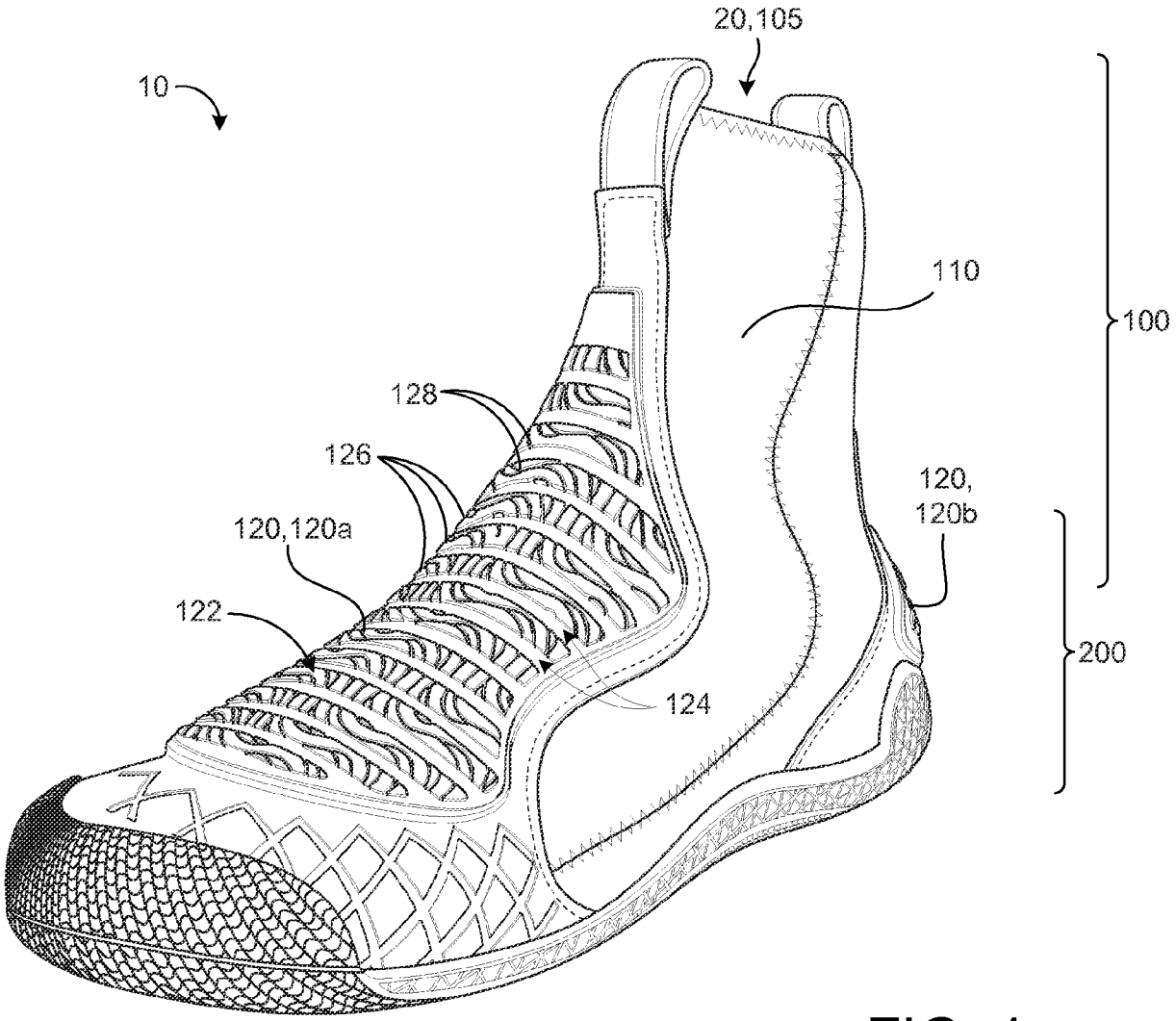
FIG. 1 is a perspective view of an exemplary article of footwear.

Like reference symbols in the various drawings indicate like elements. By way of example only, all of the drawings are directed to an article of footwear suitable to be worn on a right foot or a left foot. The invention also includes the mirror images of the drawings, i.e. an article of footwear suitable to be worn on a left foot or a right foot, respectively.

DETAILED DESCRIPTION

Referring to FIGS. 1A-3F, in some implementations, an article of footwear 10 includes an upper assembly 100 attached to a sole assembly 200 (e.g., by stitching and/or an adhesive). Together, the upper assembly 100 and the sole assembly 200 define a foot void 20 configured to securely and comfortably hold a human foot. The upper assembly 100 defines a foot opening 105 for receiving a human foot into the foot void 20. The upper assembly 100 and the sole assembly 200 each have a corresponding forefoot portion 102, 202 and a corresponding heel portion 104, 204. The forefoot portions 102, 202 may be generally associated with the metatarsals, phalanges, and interconnecting joints thereof of a received foot. The heel portions 104, 204 may be generally associated with the heel of the received foot, including the calcareous bone. Moreover, the upper assembly 100 and the sole assembly 200 each have a corresponding lateral portion 106, 206 and a corresponding medial portion 108, 208, opposite each other. The upper assembly 100 and the sole assembly 200 also include corresponding phalanges portions 101, 201 and metatarsal portions 103, 203. The phalanges portions 101, 201, forefoot portions 102, 204, metatarsal portions 103, 203, and heel portions 104, 204 are only intended for purposes of description and do not demarcate precise regions of the footwear article 10. Likewise, the lateral portions 106, 206 and the medial portions 108, 208 generally represent two sides of the footwear article 10, rather than precise demarcations of two halves of the footwear article 10. Although the examples shown illustrate a bootie, the footwear article 10 may be configured as other types of footwear, including, but not limited to shoes, sandals, flip-flops, clogs, etc.

Figure 4A:
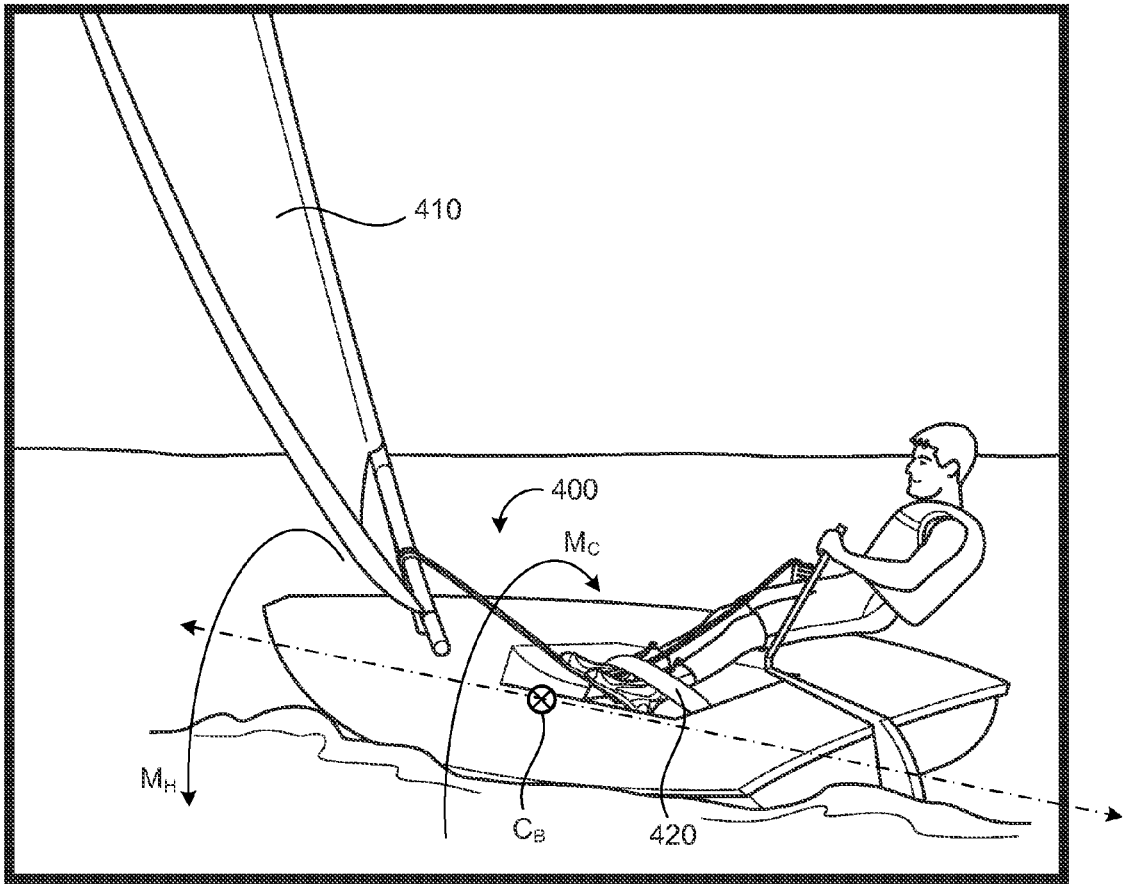
FIG. 4A is a perspective view of a person sailing.
Figure 4B:
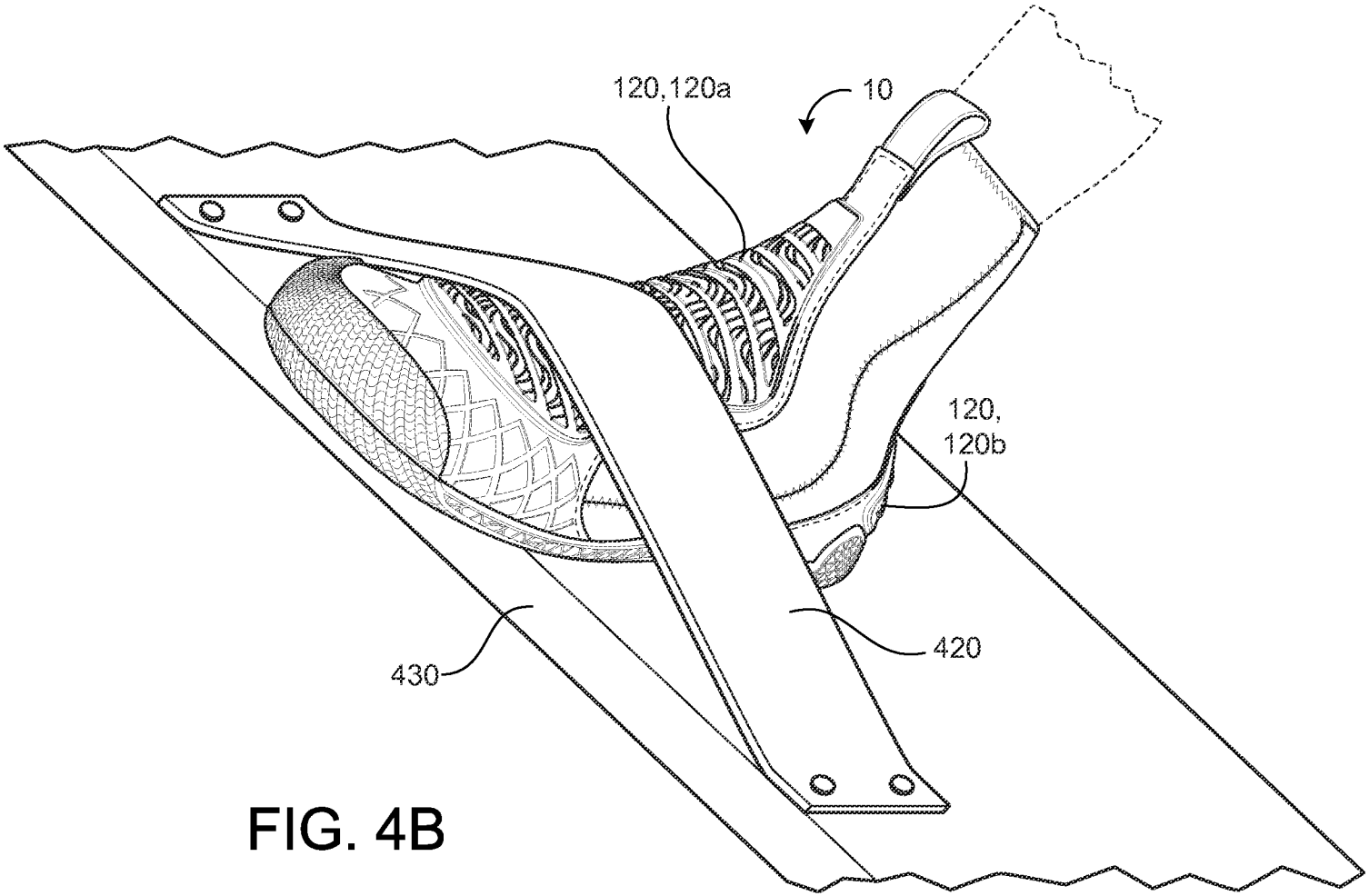
FIG. 4B is a perspective view of an exemplary article of footwear held under a hiking strap of a sailboat.
Figure 4C:
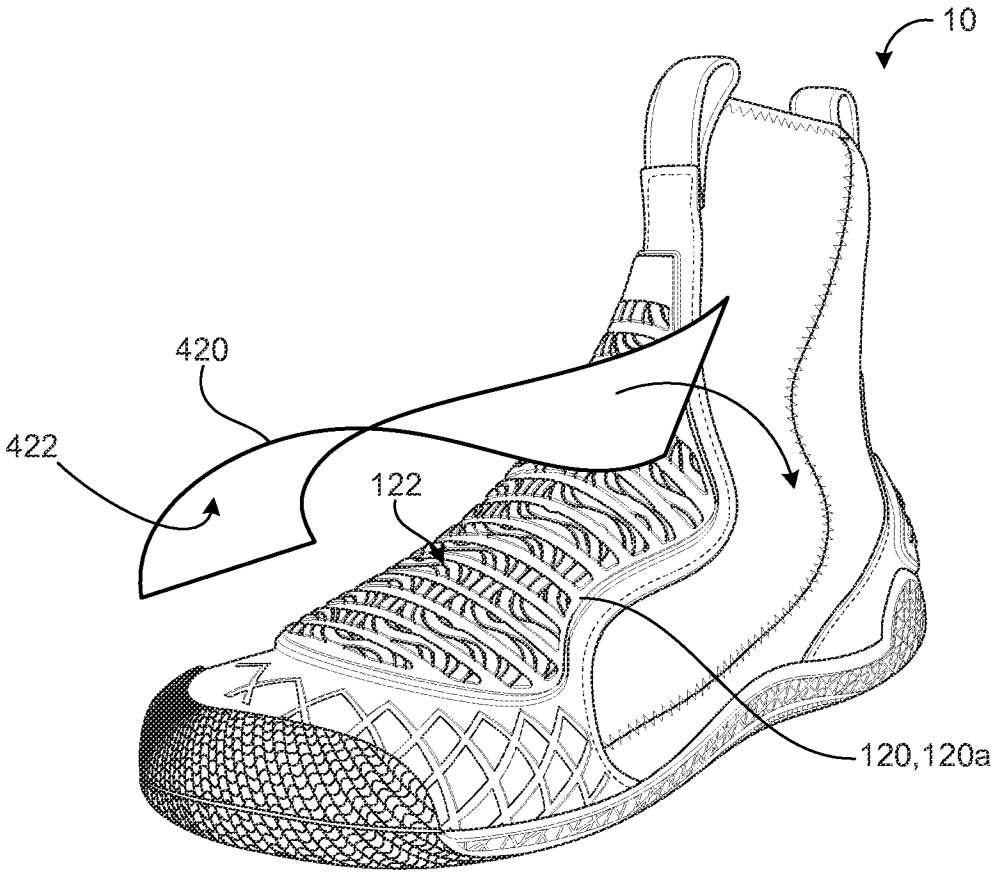
FIG. 4C is a perspective view of a sailboat hiking strap over an exemplary article of footwear.

Referring to FIGS. 4A-4C, in sailing, hiking is generally the action of moving a crew's body weight on a boat 400 as far windward (upwind) as possible, in order to decrease heeling of the boat 400 (i.e., leaning away from the wind). Moving the crews weight windward increases a crew moment $M_C$ about a center of buoyancy $C_B$ of the boat 400 to oppose an opposite, heeling moment $M_H$: about the center of buoyancy $C_B$ due to the wind pushing against one or more sails 410 of the boat 400. Hiking is usually done by leaning over the edge of the boat 400 as it heels. Some boats 400 are fitted with equipment such as hiking straps 420 (or toe straps) and trapezes 430 to make hiking more effective. Hiking is usually integral to catamaran and dinghy sailing, where the wind can capsize the lightweight boat unless the sailor counteracts the wind's pressure by hiking, or eases the sails to reduce it.

Many boats, especially dinghies, have equipment that facilitates effective hiking. For example, hiking straps 420, which can be made from rope or webbing, hold one or more feet of the sailor (e.g., as shown in FIGS. 4B and 4C), allowing the sailor to lean back over the edge of the boat 400 while facing toward the boat 400. The footwear article 10 may be configured to provide slip-resistance under the hiking strap 420 and on the trapeze board 430, so as to avoid dislodgement of the sailor's foot from under the hiking strap 420.

Referring again to FIGS. 1-3F, the upper assembly 100 includes a first layer 110 (e.g., an enclosure layer) that may extend from the phalanges upper portion 101 or the metatarsal upper portion 103 to the heel portion 104 of the upper 100. The first layer 110 may comprise Neoprene or polychloroprene (e.g., a synthetic rubber produced by polymerization of chloroprene), a mesh material (e.g., two-way, four-way, or three-dimensional mesh), a combination thereof or some other suitable material. The first layer 110 may be water proof or at least water resistant. Moreover, the first layer 110 may be configured to insulate or maintain a certain temperature of a wearer's foot.

Figure 5:
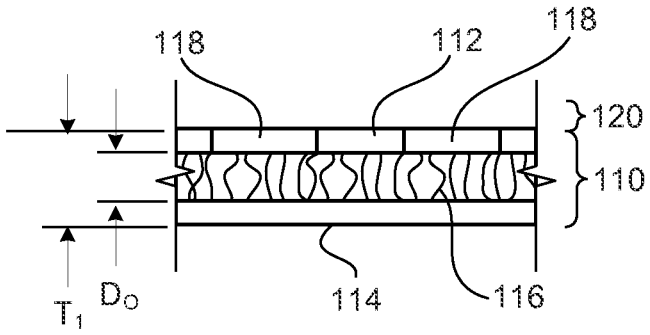
FIG. 5 is a section view of an exemplary footwear upper layer.

In the example shown in FIG. 5, the first layer 110 includes a three dimensional mesh material having an inner layer 112, an outer layer 114, and fibers, threads, or filaments 116 extending therebetween in an arrangement that allows air and moisture to pass between the inner and outer layers 112, 114. The filaments 116 may be a loose configuration fibers a random or ordered arrangement. Moreover, the inner and outer layers 112, 114 can be offset for each other by a fixed or variable distance $D_O$ limited by the filaments 116 attached between the two layers 112, 114. One of the inner and outer layers 112, 114 may define apertures 118 (e.g., circular having a diameter of between about 1 mm and about 20 mm) to provide additional breathability through the first layer 110. The first layer 110 may have a thickness $T_1$ of between about 1 mm and about 1 cm. Other thickness are possible as well.

Referring again to FIGS. 1-3F, in some implementations, the upper assembly 100 includes a second layer 120 disposed on the first layer 110. In the examples shown, the upper 100 includes a top second layer **120*a* disposed on a top portion 107 of the upper 100 (e.g., including at least the metatarsal portion 103) and a heel second layer 120*b* disposed on the first layer 110 in the heel portion 104 of the upper 100. The heel second layer 120*b* provides slip resistance for maintaining a position on an engaged surface, such as the trapeze board 530. For example, while hiking on a sail boat 400, the wearer may lean back and push off the heel second layer 120*b* to lean away from the boat 400. The second layer 120 can be disposed on other portions of the upper 100 as well, including and not limited to the forefoot portion 102, the phalanges portion 101, the metatarsal portion 103, the heel portion 104, the lateral portion 106, and/or the medial portions 108. In some implementations, the second layer 120 extends from the phalanges portion 101 or the metatarsal portion 103 of the upper 100 to or near the foot opening 105**.

In the examples shown in FIGS. 3A-3E, the footwear article 10 includes lateral and medial second layers **120*c*, 120*d* disposed on corresponding lateral and medial portions 106, 108 of the first layer 110 of the tipper 100. The lateral and medial second layers 120*c*, 120*d* can be arranged to provide traction on the sides of the footwear article 10 (e.g., for holding the footwear article 10 against a surface by engaging the surface along a direction of the transverse axis 13 (perpendicular to a walking direction)). The combination of the second layer(s) 120, 120*a-d* and the sole assembly 200 can provide substantially 360 degree traction about the footwear article 10, which can be beneficial for sailboat hiking A contact surface 122 of the second layer(s) 120, 120*a-d* may engage a contact surface 422** of the hiking strap to provide a slip-resistant engagement between the two.

The second layer 120 may be configured to provide traction and/or padding for engaging a hiking strap 420 of a sail boat 400. In some examples, the second layer 120 comprises rubber, such as a sticky rubber that provides a non-slip characteristic to the second layer 120. The second layer 120 may comprise rubber, such as a sticky rubber that provides a non-slip characteristic, and have a thickness $T_2$ that reduces or eliminates impingement of the hiking strap 420 into the wearer's foot (e.g., a thickness $T_2$ of between about 1 mm and about 1.5 cm, or about 2 mm). In some examples, the second layer 120 has durometer of between about 35 Shore A and about 70 Shore A.

Figure 2A:
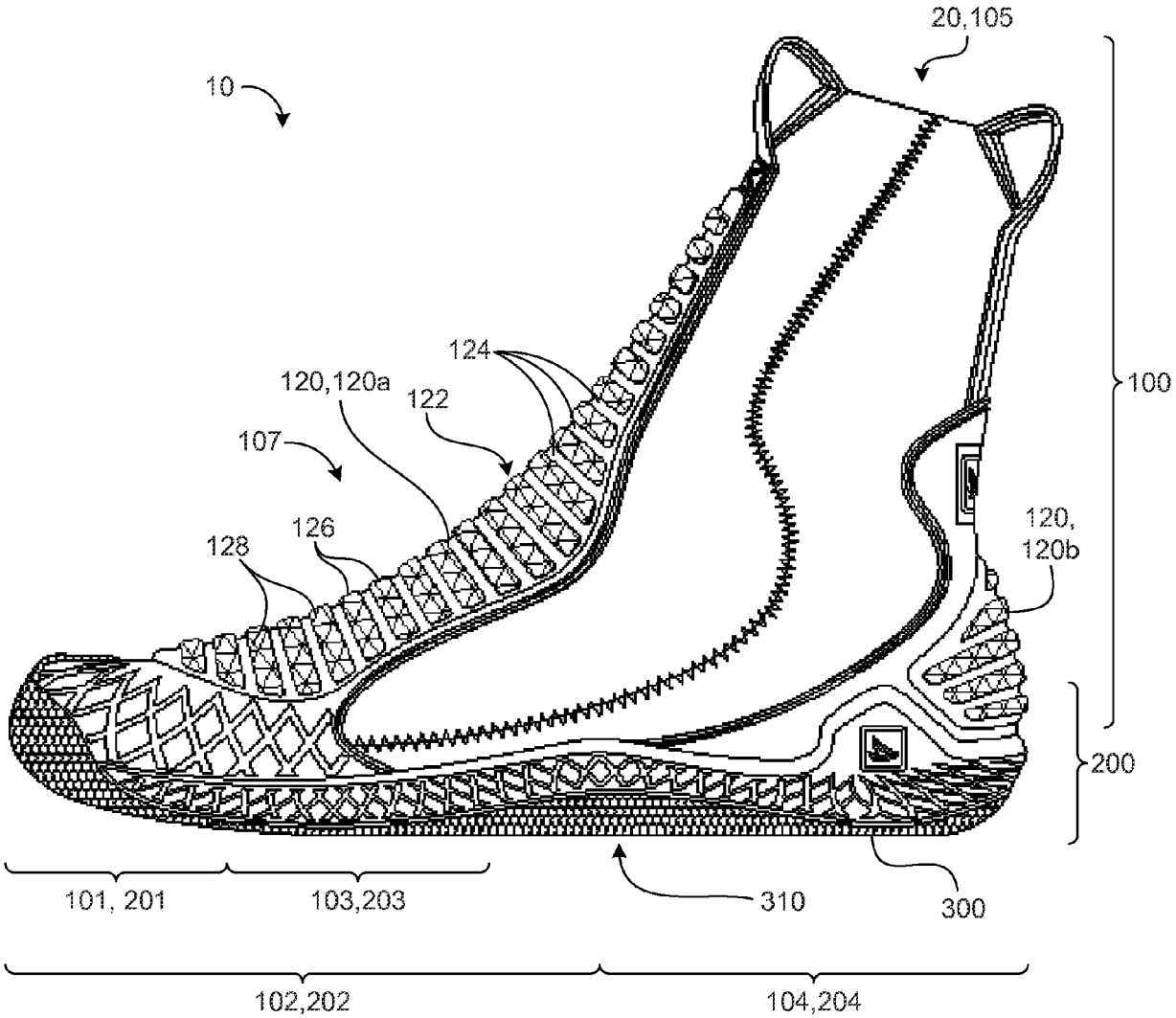
FIG. 2A is a medial side view of an exemplary article of footwear.
Figure 2B:
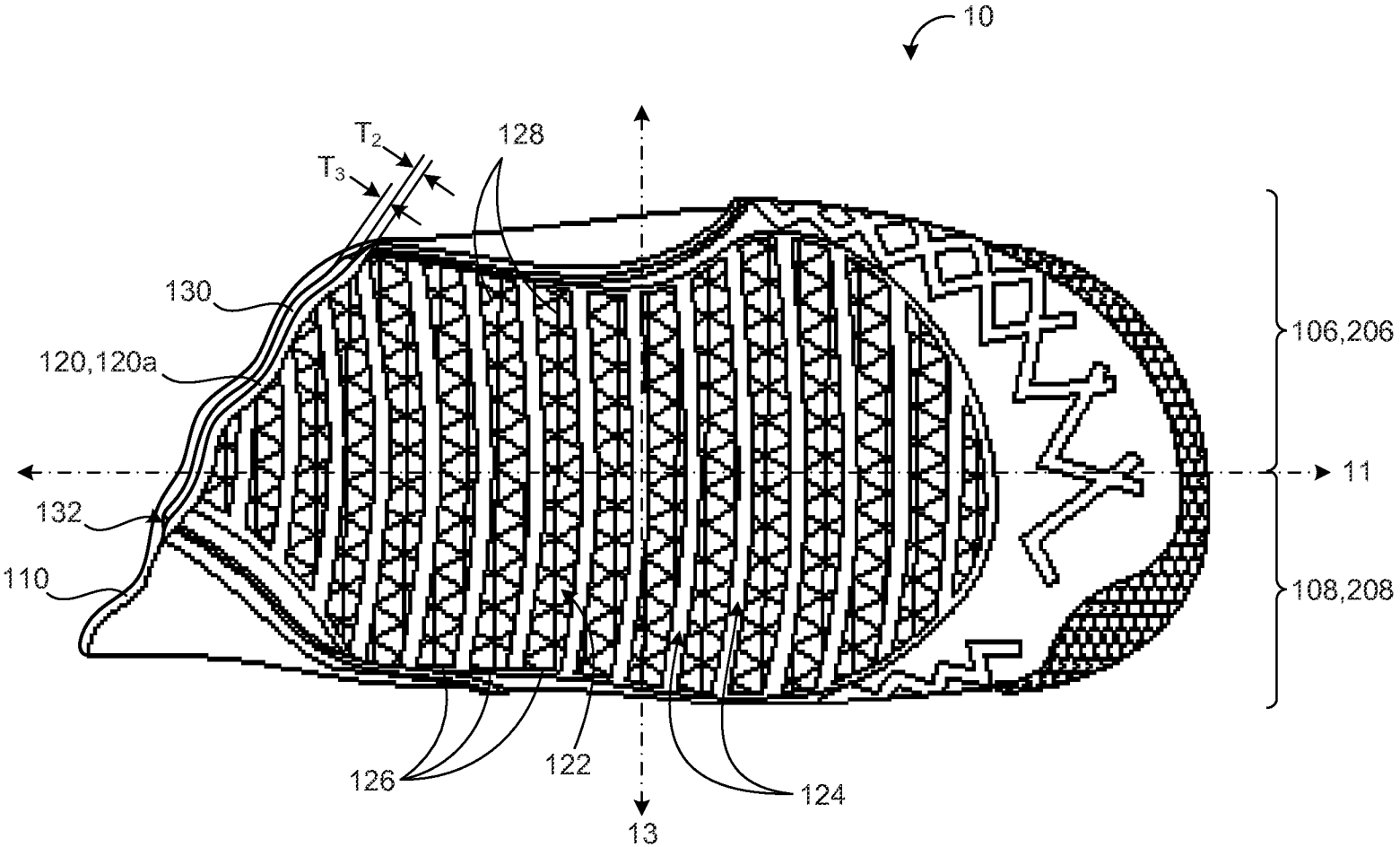
FIG. 2B is a partial top view of the footwear article shown in FIG. 2A.
Figure 3A:
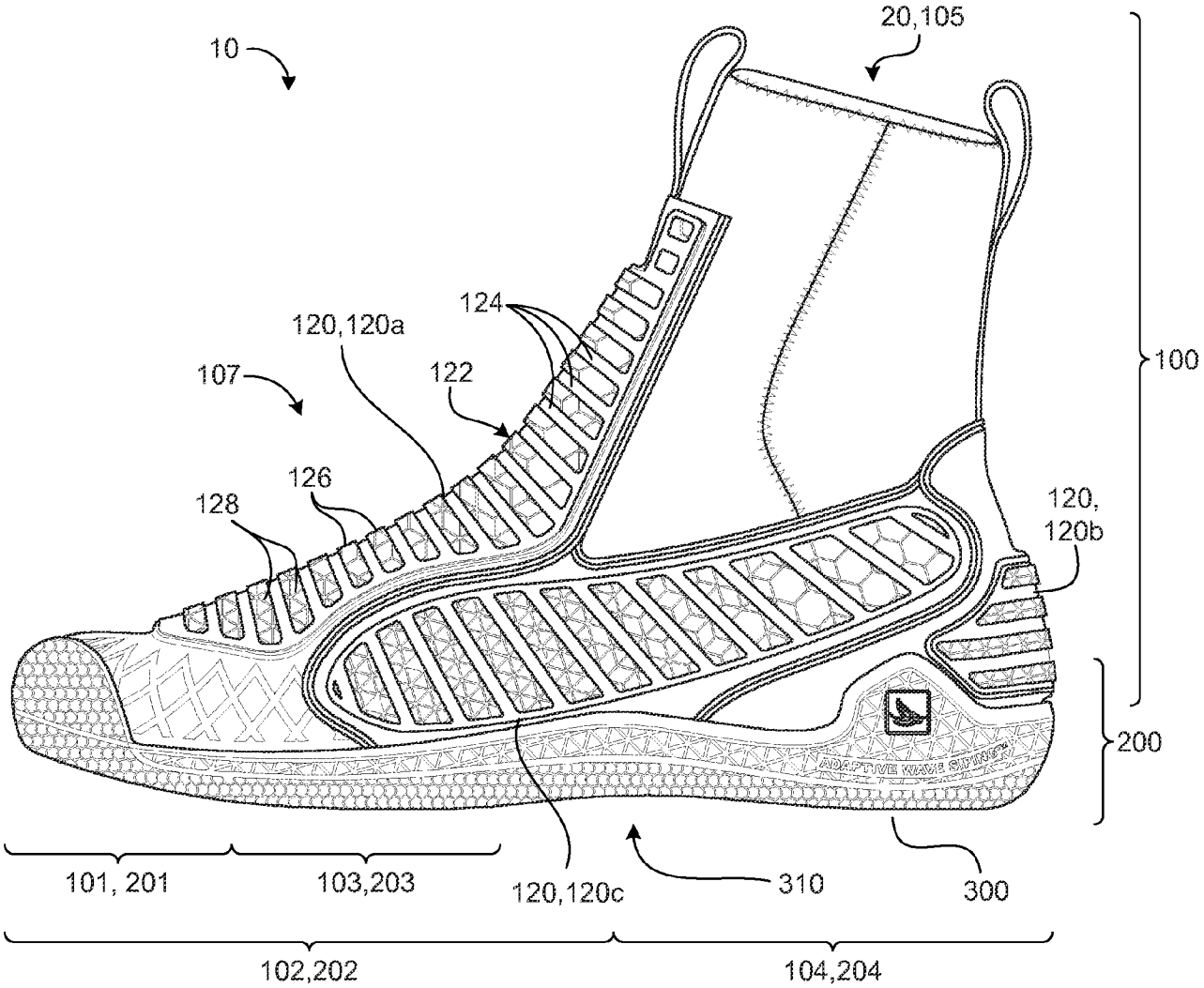
FIG. 3A is a lateral side view of an exemplary article of footwear.
Figure 3B:
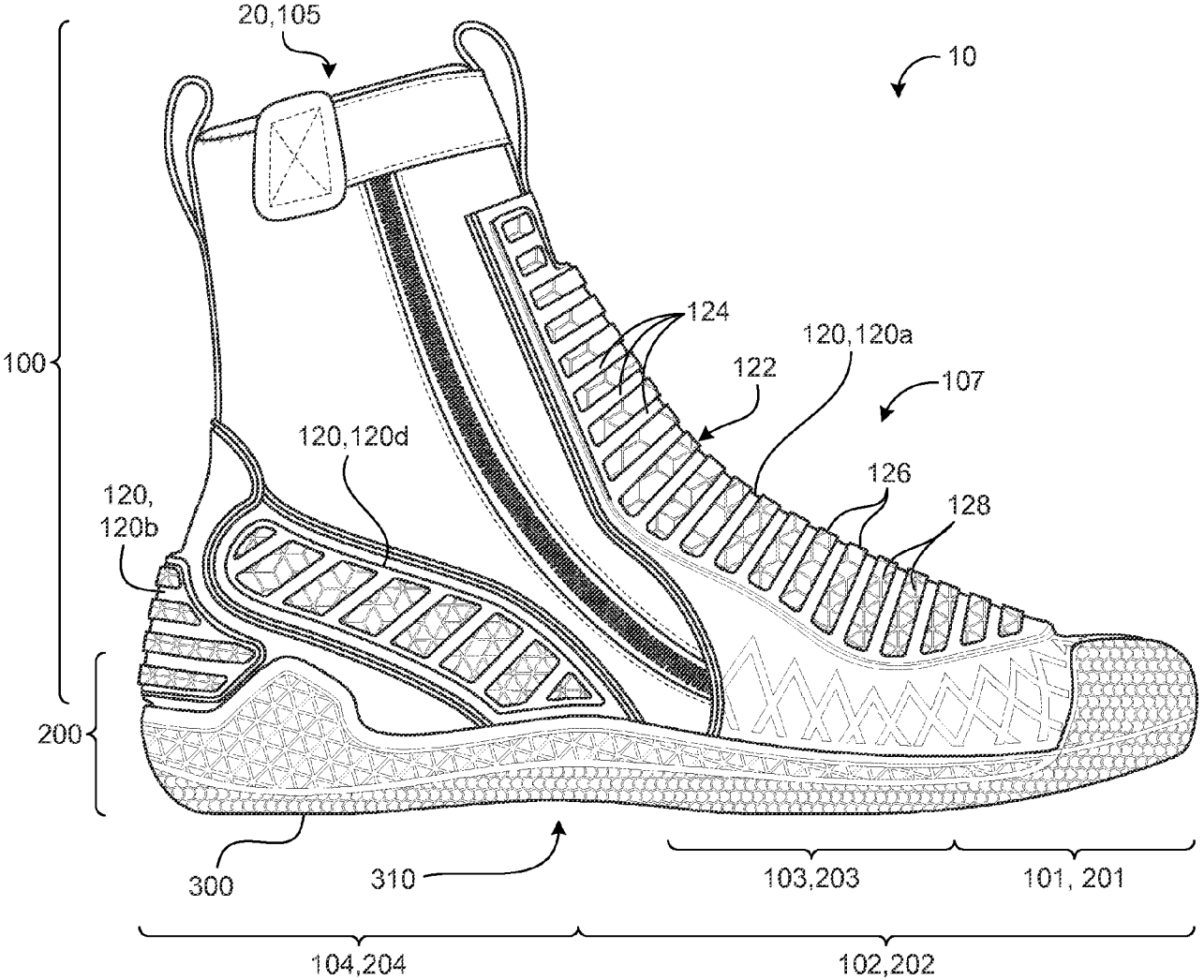
FIG. 3B is a medial side view of the footwear article shown in FIG. 3A.
Figure 3C:
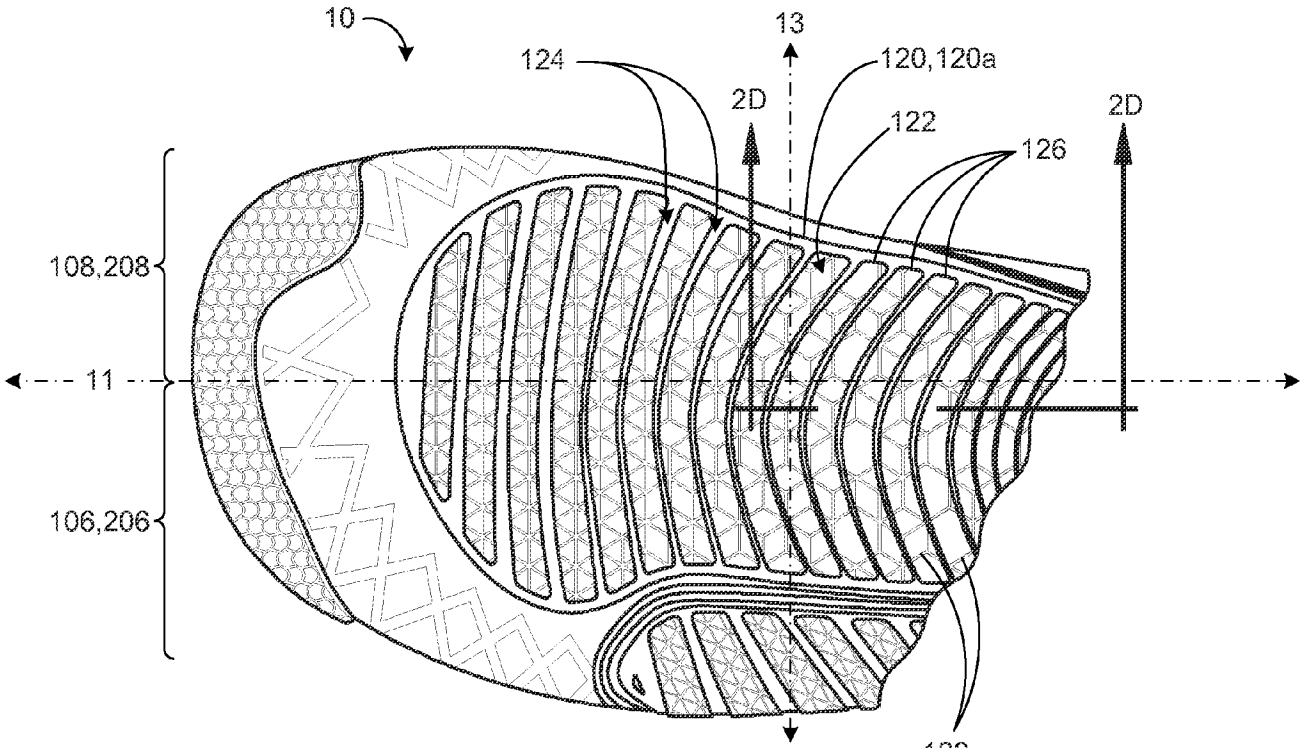
FIG. 3C is a partial top view of the footwear article shown in FIG. 3A.
Figure 3D:
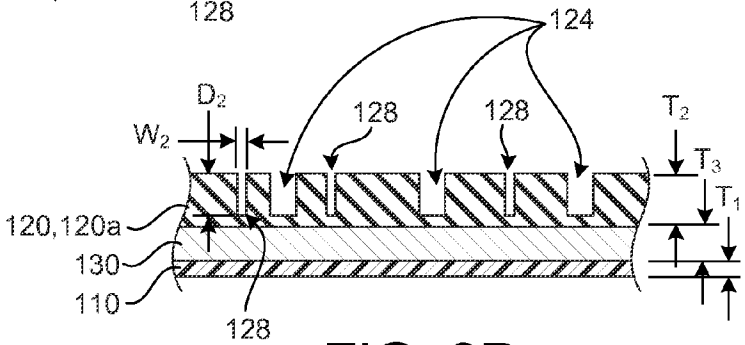
FIG. 3D is a section view of the footwear article shown in FIG. 3C along line 3D-3D.
Figure 3E:
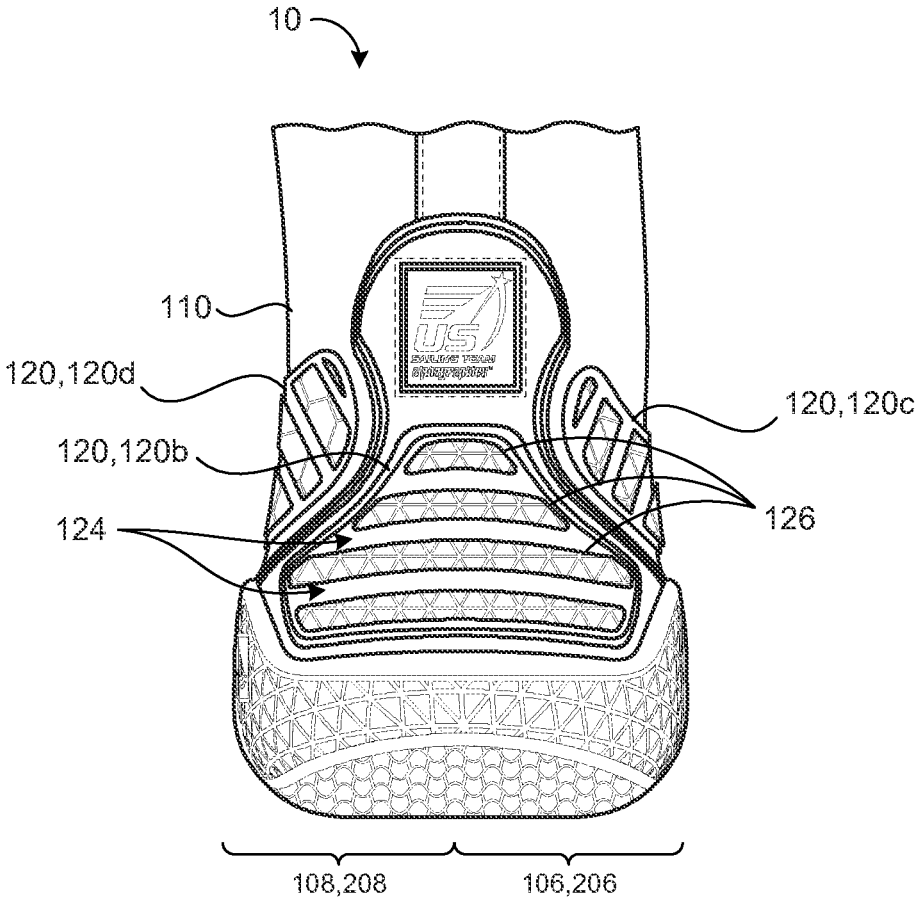
FIG. 3E is a partial rear view of the footwear article shown in FIG. 3A.
Figure 3F:
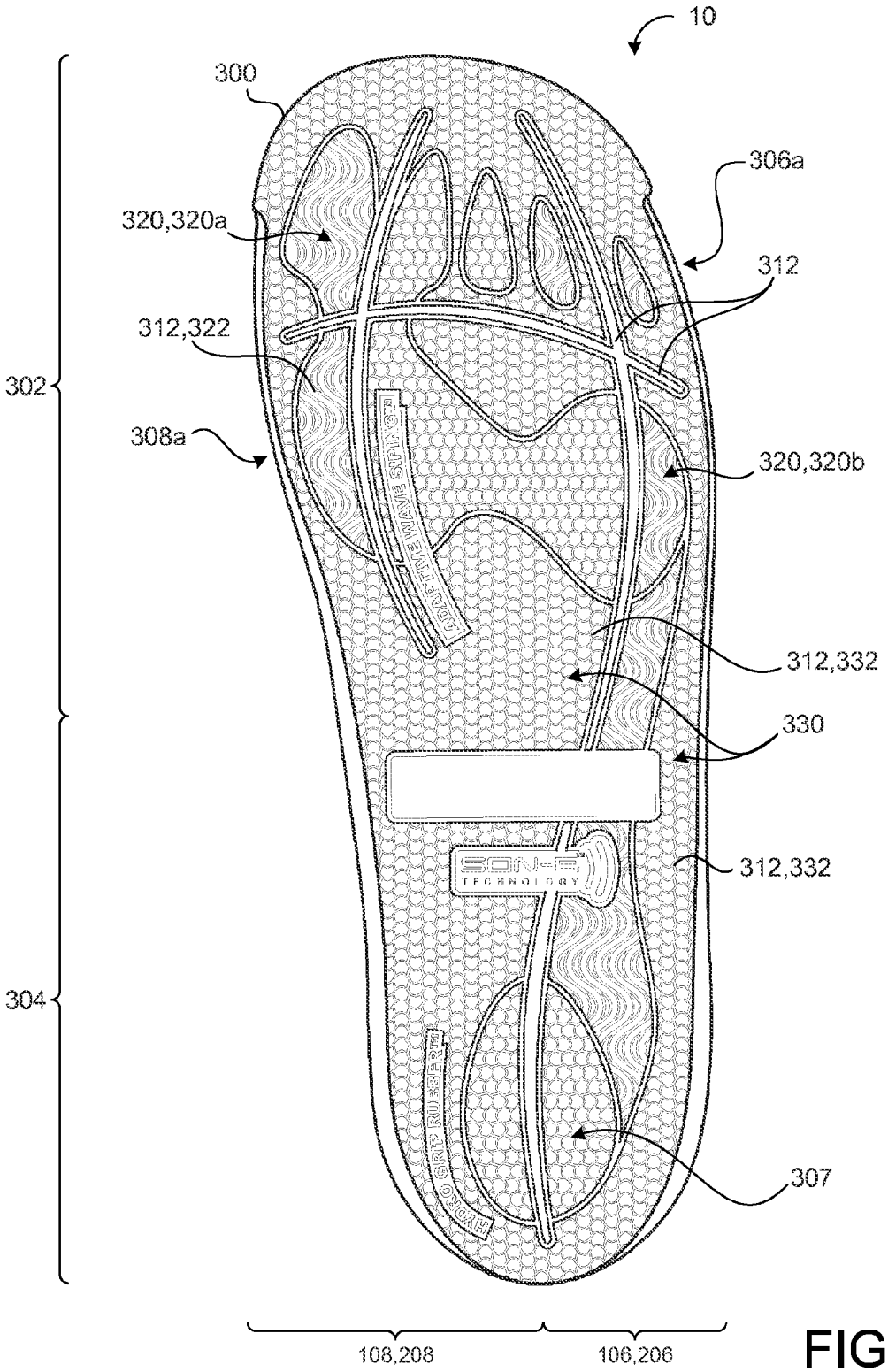
FIG. 3F is a bottom view of the footwear article shown in FIG. 3A.

For added comfort and padding, a third layer 130 (e.g., a cushion layer) may be disposed between the first and second layers 110, 120, as in the examples shown in FIGS. 2B, 3C and 3D. Each or any of the second layers 120, 120*a-d* may be formed (e.g., molded) to define a void or pocket 132 (FIG. 2B) with the first layer 110, when disposed on the first layer 110, for housing the third layer 130. In some examples, the third layer 130 may be made of Neoprene (or polychloroprene), rubber, foam, ethylene vinyl acetate (EVA), or another suitable material. The third layer 130 may have a thickness $T_3$ that reduces or eliminates impingement of a hiking strap into the top of a wearer's foot (e.g., a thickness $T_3$ of between about 1 mm and about 1 cm). Similarly, the second layer 120 may have a thickness $T_2$ that reduces or eliminates impingement of a hiking strap 420 into the top of a wearer's foot (e.g., a thickness $T_2$ of between about 1 mm and about 1 cm).

Referring again to FIGS. 1-3F, the contact surface 122 of the second layer 120, 120*a-d* (e.g., an exterior surface) may define a tread pattern that enhances traction on that surface. While hiking on a sail boat 400, the tread pattern provides slip resistance of the second layer 120 to impede the footwear article 10 from slipping out from under the hiking strap 420. In the examples shown, the contact surface 122 of the second layer 120 defines a series of channels 124 forming ribs or bars 126 that can be arranged at least substantially parallel (or parallel) to each other and to a transverse axis 13 of the footwear article 10. The ribs or bars 126 provide traction and allow escapement of water from the contact surface 122. Moreover, the parallel channels 124 may facilitate articulation or flexing of the top second layer 120, 120*a* about the traverse axis 13, thus allow the upper 100 to bend and flex with the movement of a received foot (e.g., with foot flexion).

In some implementations, the contact surface 122 defines grooves 128, such as siped grooves (e.g., molded and/or razor cut), having a tread configuration designed for slip resistance. The plurality of grooves 128 receive water escaping from between the contact surface 122 and an object pressing against it, such the hiking strap 420. Liquid can flow in the channels 124 and/or grooves 128 toward a perimeter of the contact surface 122 (i.e., away from weight-bearing and contact surfaces). For example, water can flow from the grooves 128 into the channels 126 between the ribs 124 to a perimeter of the second layer 120. The grooves 128 may be adequately sized for liquid movement there-through, while deterring the accumulation of small objects therein. Moreover, the grooves 128 may flex open (e.g., during foot flexion/extension), providing traction and water escapement from the contact surface 122. In some implementations, the channels 124 and/or grooves 128 are cut into the traction pad 120, while in other implementations, the channels 124 and/or grooves 128 are molded with the traction pad 120.

Referring to FIG. 3D, the grooves 128 can have a width $W_2$ of between about 0.1 mm to about 5 mm (e.g., 1.2 mm) and/or a depth $D_2$ of between about 25% to about 75% of a thickness $T_2$ of the second layer 120. In some examples, the second layer 120 has a thickness $T_2$ (FIG. 2D) of between about 1 mm an about 10 mm. For example, for a second layer 120 having a thickness $T_2$ of 3.5 min, the grooves 128 can have a depth $D_2$ of between about 0.8 mm and about 2.6 mm a depth $D_2$ of 1 mm, 2 mm, or 2.5 mm). Siped grooves 128 may have a relatively thin width $W_2$ as compared to other types of grooves 128. Siped grooves 128 may be formed by razor cutting the groove 128 into the second layer 120 or molding the groove 128 with a relatively narrow width $W_2$.

The groove and or channel configuration can be arranged to have a certain edge density and a certain surface contact ratio to provide a certain level of traction performance (or resistance to slip). Edge density can be defined as a length of surface edges of the contact surface 122 (e.g., the cumulative length (millimeters) of edges on the contact surface 122 from the channels 124 and/or grooves 128) within a square centimeter. In general, the greater the edge density, the greater the traction; however, manufacturability, aesthetics, resistance to wear and other factors may limit the edge density. The surface contact ratio can be defined as an overall area of the contact surface 122 minus a groove area of the contact surface 122 (i.e. an area of the contact surface removed for the channels 124 and/or grooves 128) divided by the overall area of the contact surface 122. In dry conditions, a surface contact ratio of 100% can provide the best traction; however, a contact surface 122 with no channels 124 or grooves 128 provides very poor traction or slip resistance in wet conditions. Therefore, a relationship or balance between the edge density and the surface contact ratio of the contact surface 122 can provide certain traction and performance characteristics of the traction pad 120 in various environmental conditions.

Figure 6A:
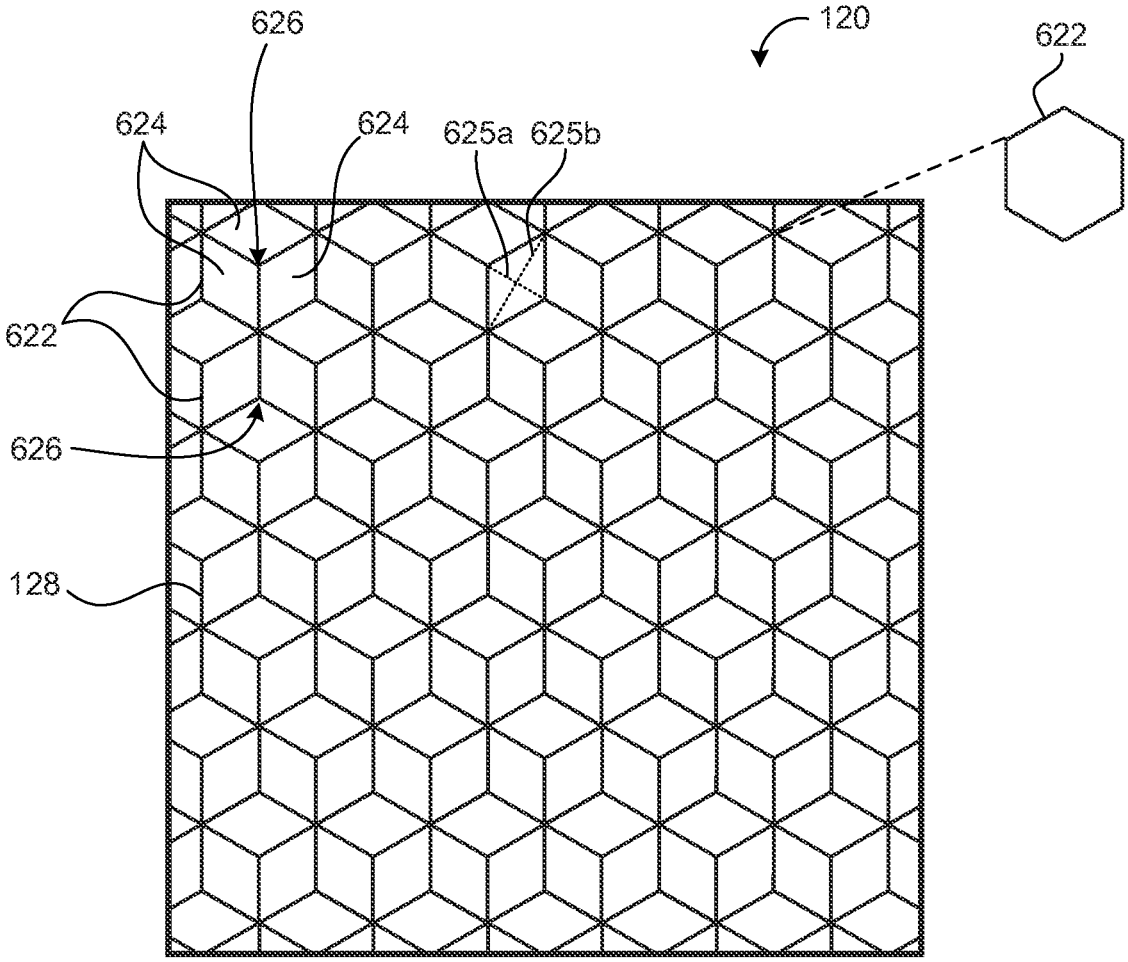
FIGS. 6A and 6B are top views of exemplary footwear upper layers.

Referring to FIG. 6A, the second layer 120 may define the grooves 128 in a hexagonal or rhombille tiling of figures 622 (e.g., molded or siped grooves in the shape of the figure 622). In geometry, rhombille tiling is generally a tessellation of 60° rhombi 624 on a Euclidean plane. A tessellation or tiling of the plane is generally a pattern of plane figures that fills the plane with no overlaps and no gaps. There may be two types of vertices, one with three rhombi 624 and one with six rhombi 624. In some examples, the hexagonal tiling may be arranged such that each figure 622 is a hexagon divided into three rhombi 624 meeting at a center point 626 of the hexagon 622. The diagonals 625*a*, 625*b* of each rhombus 624 can have a ratio of $1:\sqrt{3}$. In the example shown, the second layer 120 defines a groove pattern 610 of interconnecting hexagon figures 622.

Figure 6B:
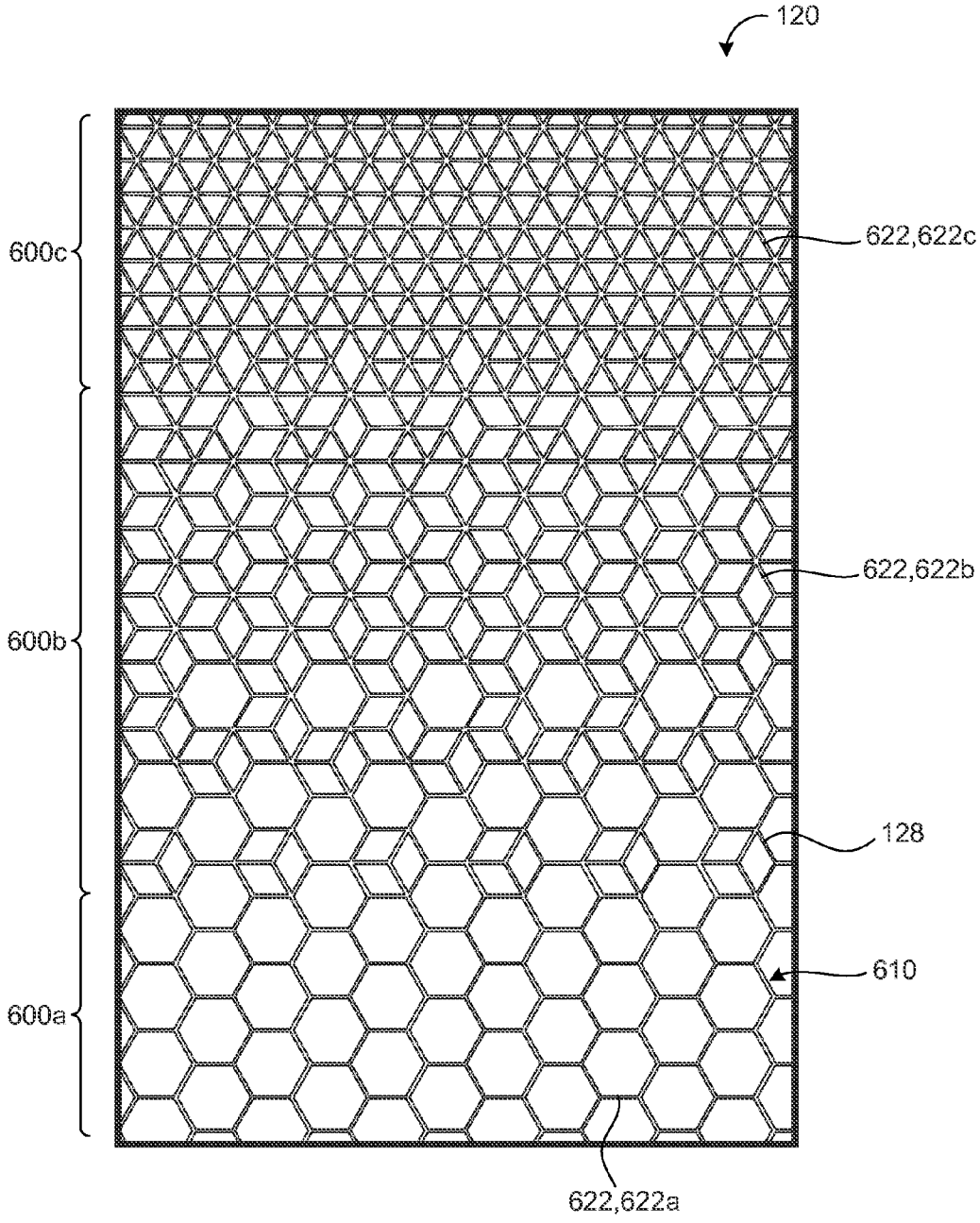
Figure 7A:
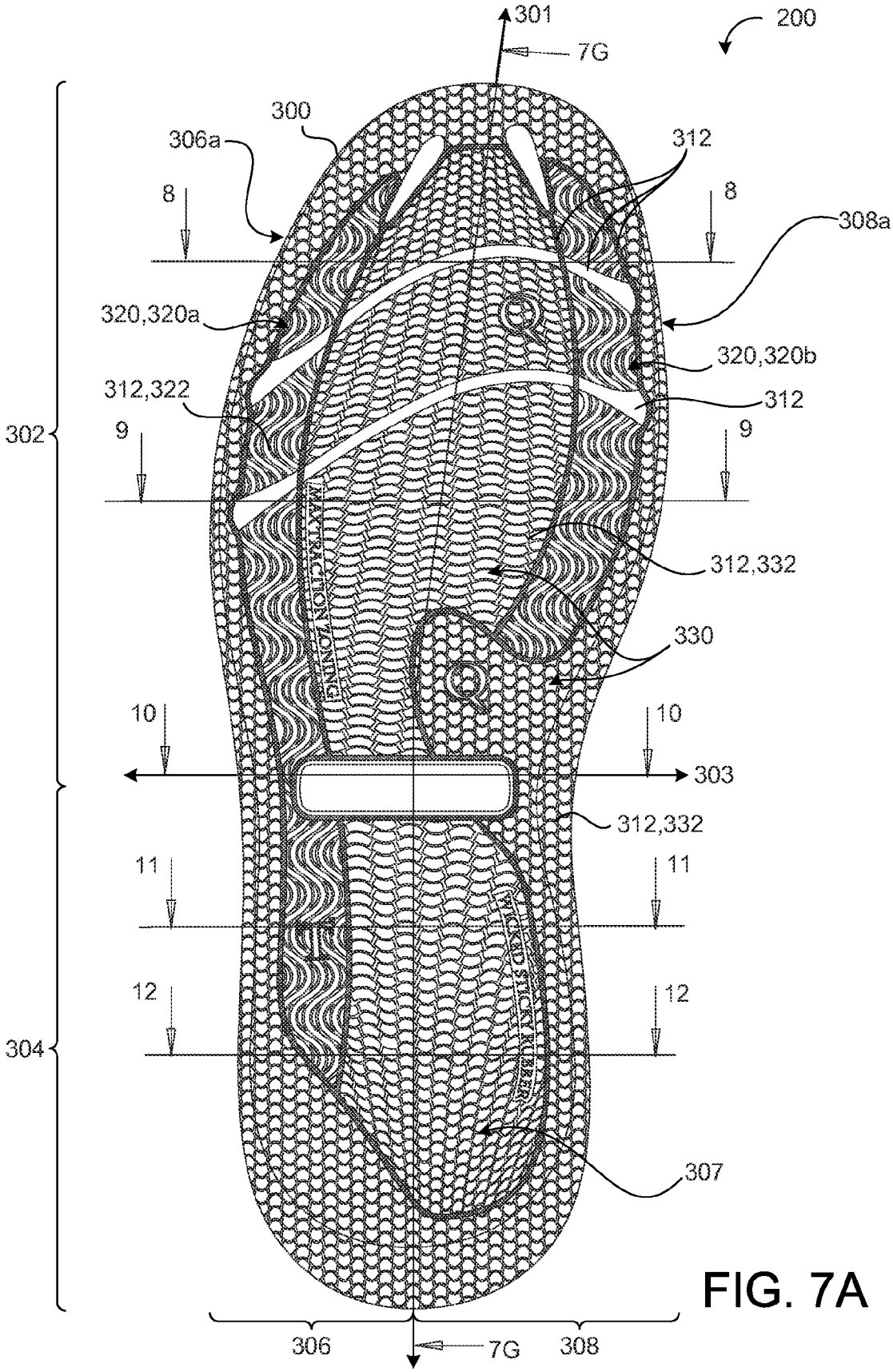
FIG. 7A is a bottom view of an exemplary sole assembly.
Figure 7B:
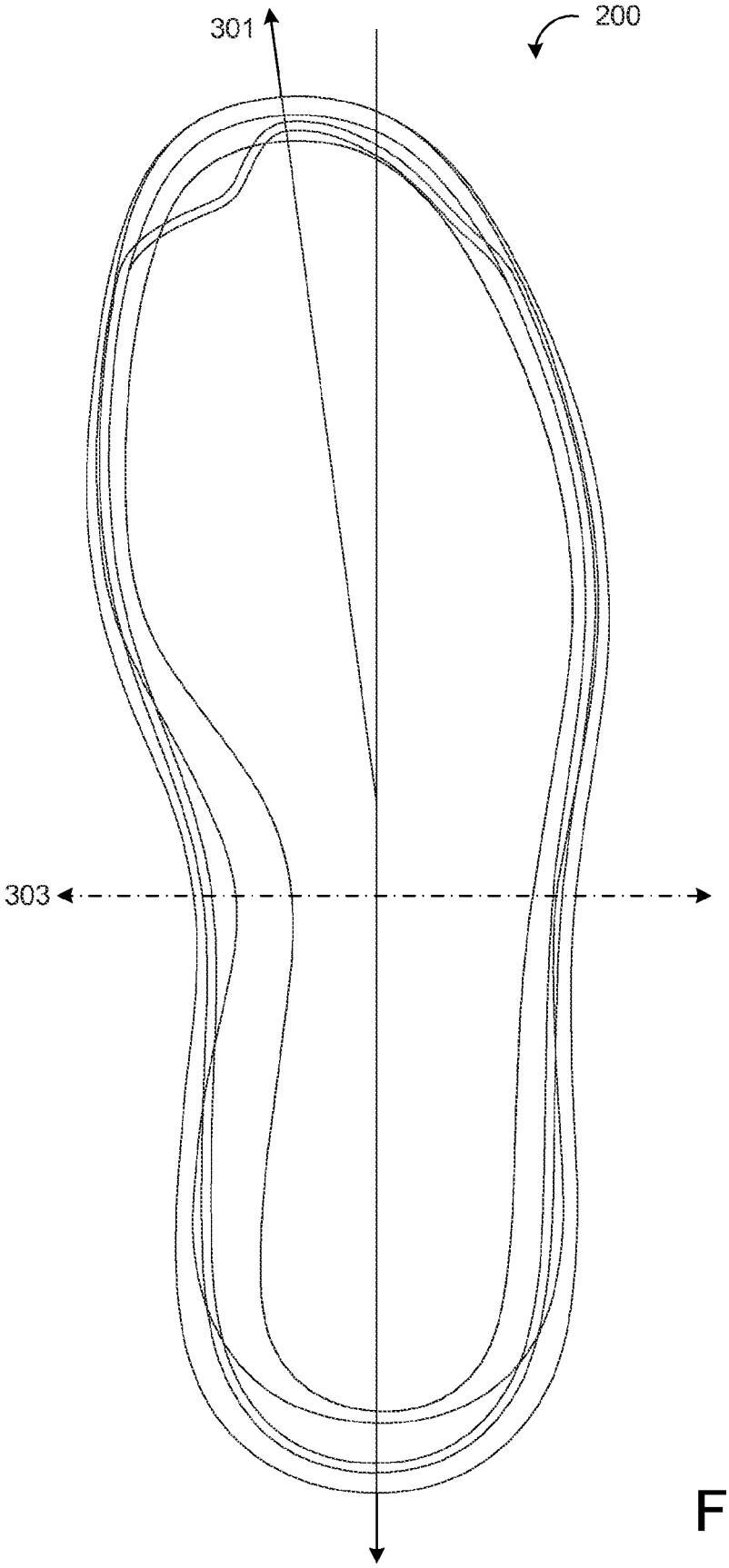
FIG. 7B is a top view of the sole assembly shown in FIG. 7A.
Figure 7C:
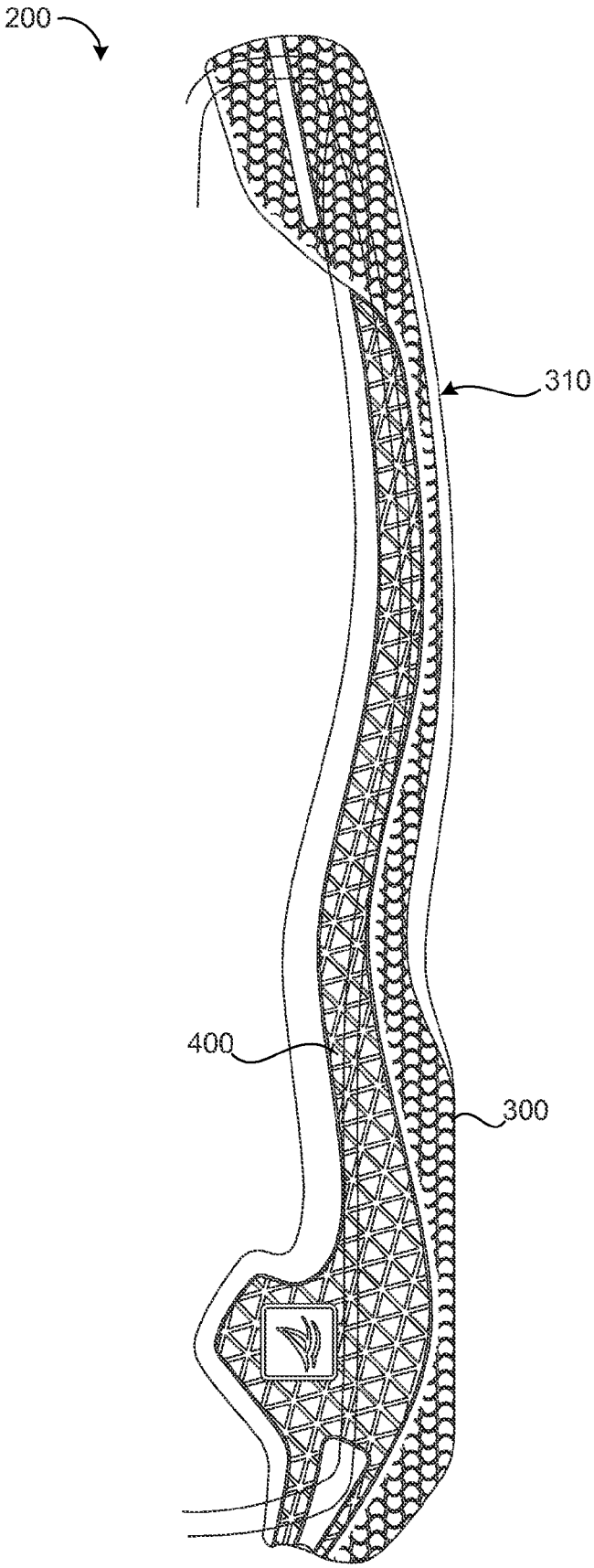
FIG. 7C is a lateral side view of the sole assembly shown in FIG. 7A.
Figure 7D:
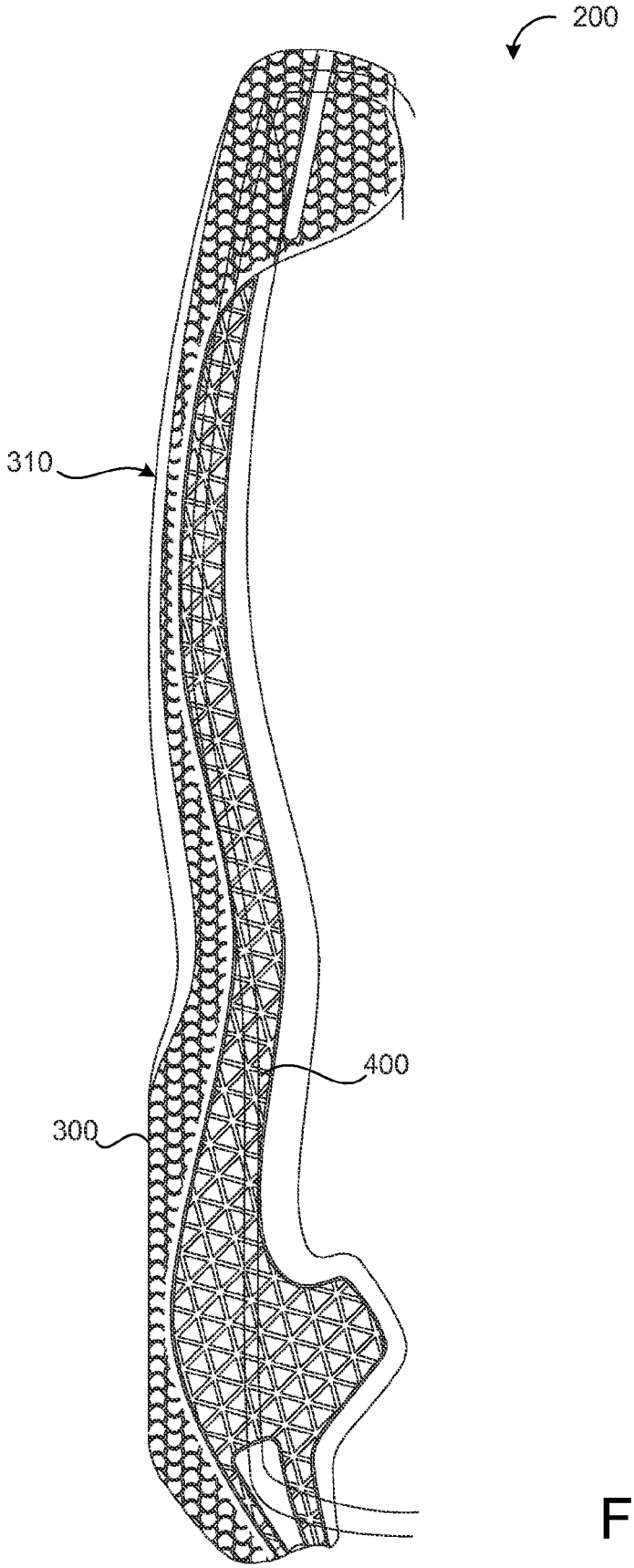
FIG. 7D is a medial side view of the sole assembly shown in FIG. 7A.
Figure 7E:
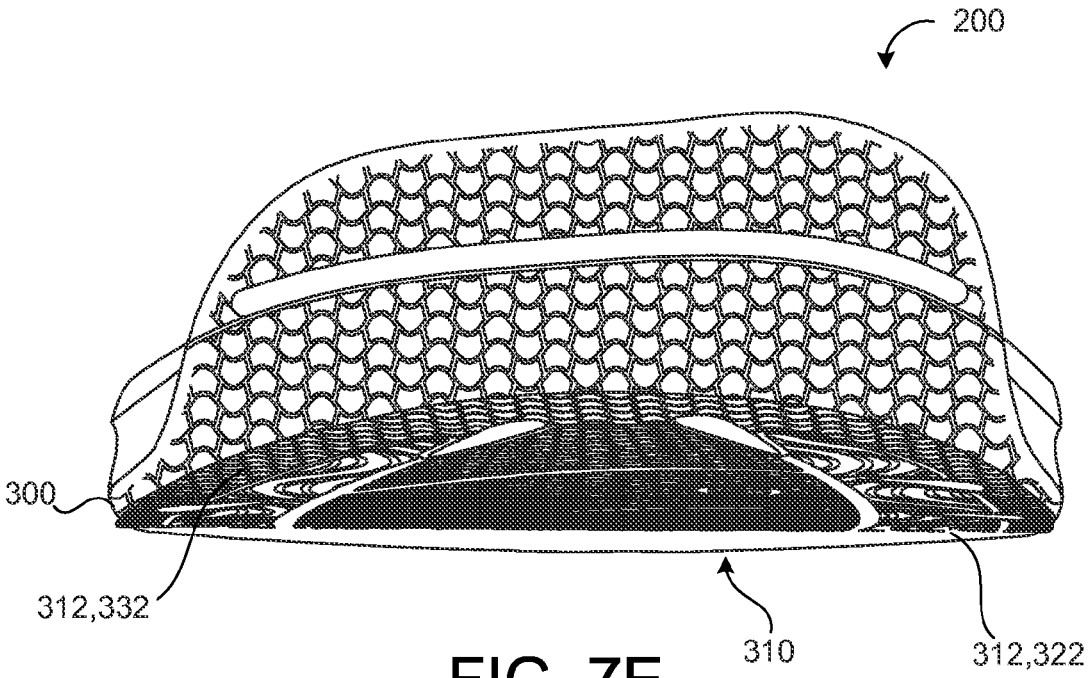
FIG. 7E is a front view of the sole assembly shown in FIG. 7A.
Figure 7F:
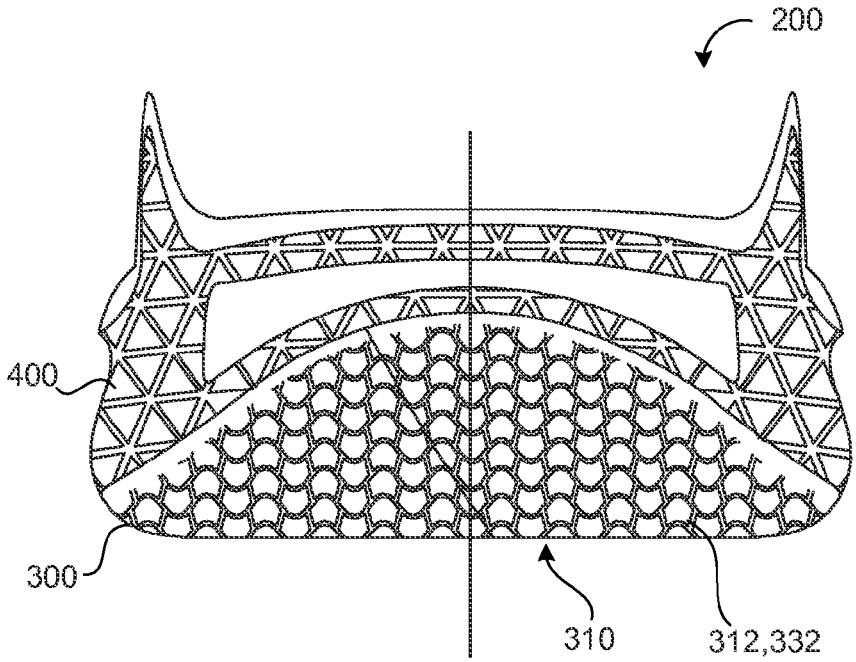
FIG. 7F is a rear view of the sole assembly shown in FIG. 7A.
Figure 7G:
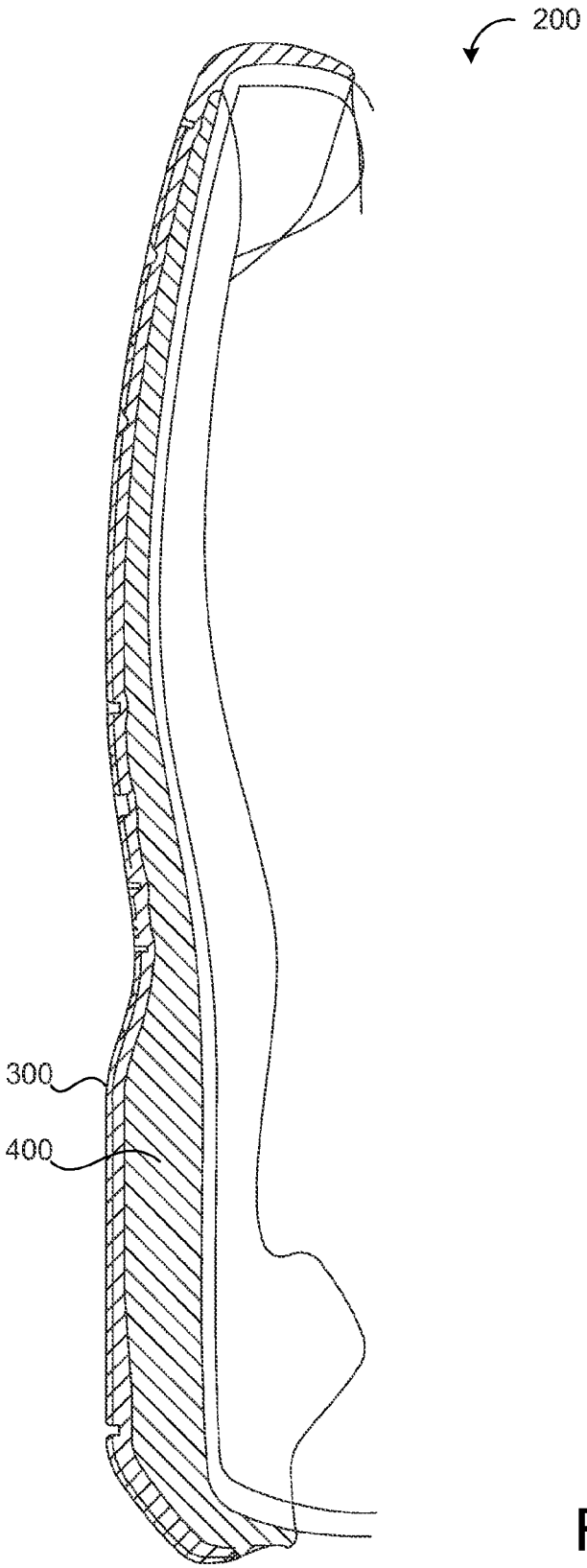
FIG. 7G is a section view of the sole assembly shown in FIG. 7A along line 7G-7G.
Figure 8:
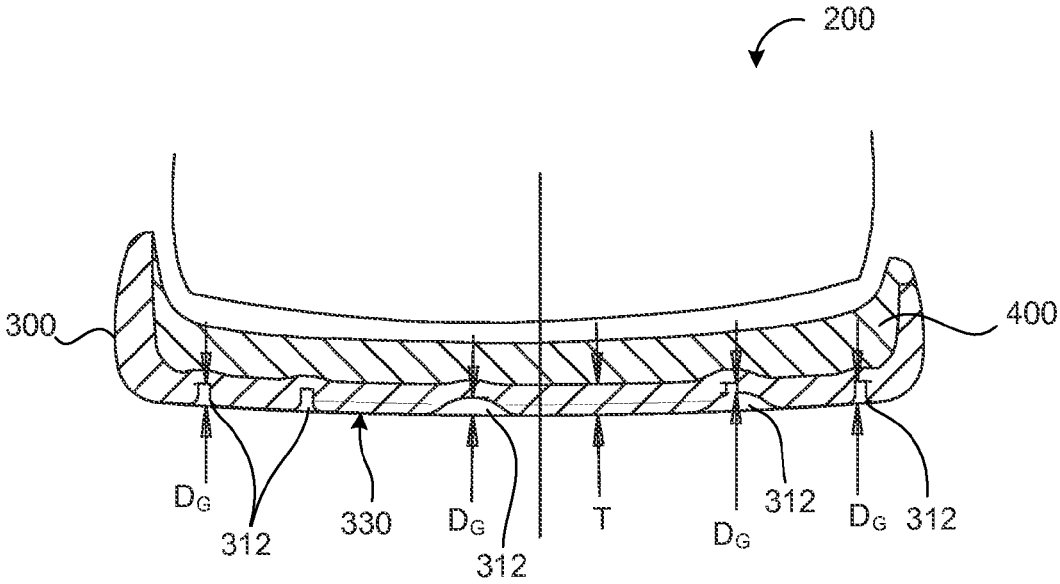
FIG. 8 is a section view of the sole assembly shown in FIG. 7A along line 8-8.
Figure 9:
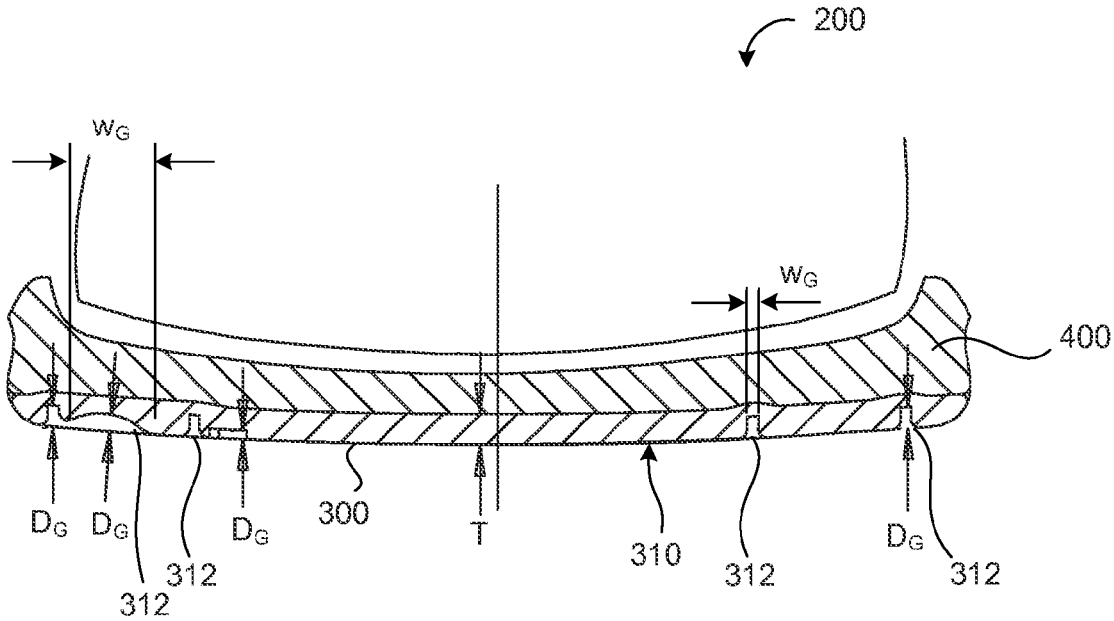
FIG. 9 is a section view of the sole assembly shown in FIG. 7A along line 9-9.
Figure 10:
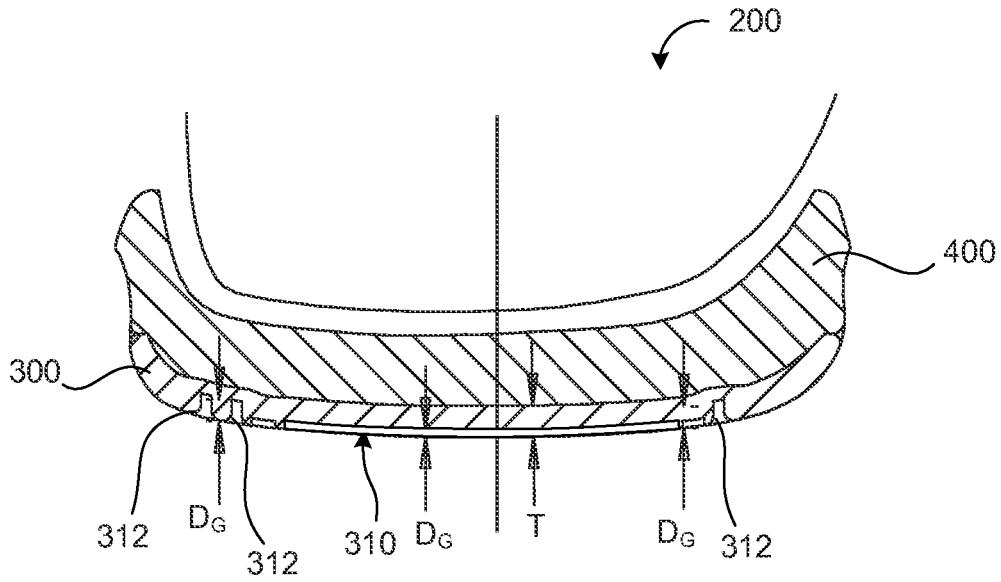
FIG. 10 is a section view of the sole assembly shown in FIG. 7A along line 10-10.
Figure 11:
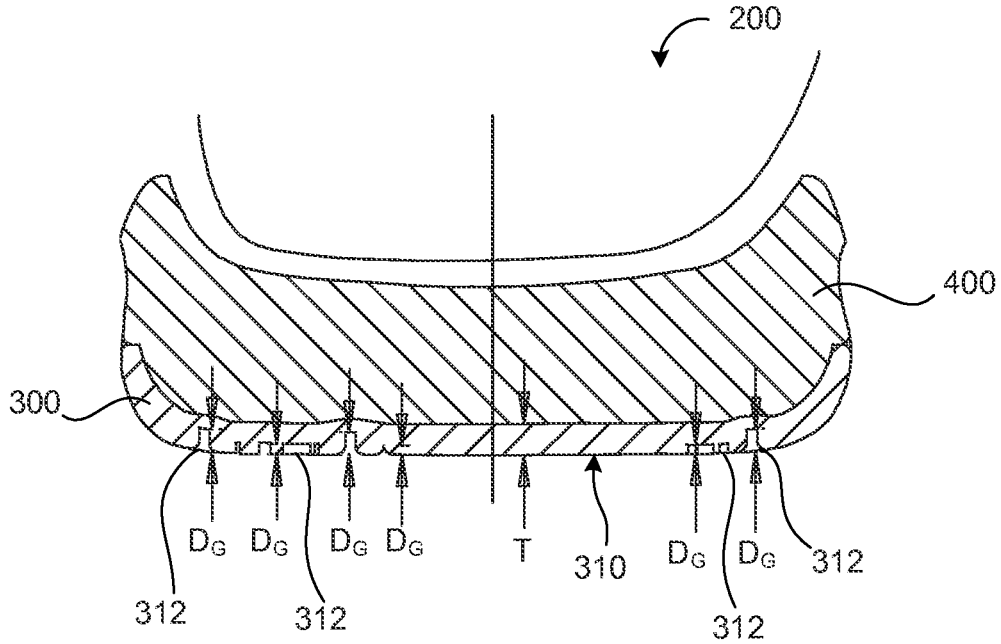
FIG. 11 is a section view of the sole assembly shown in FIG. 7A along line 11-11.
Figure 12:
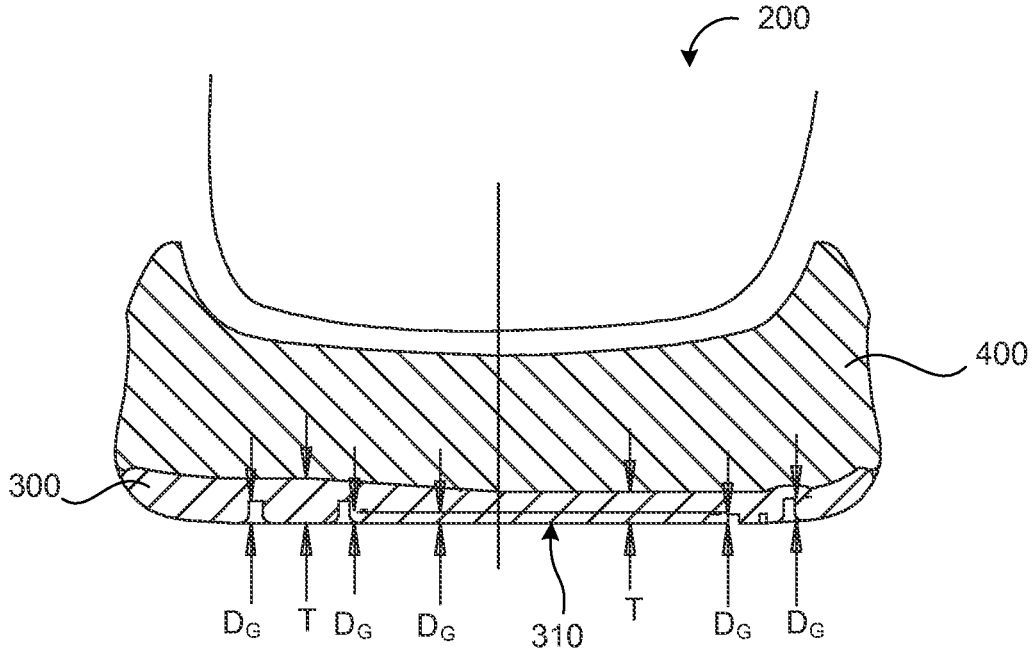
FIG. 12 is a section view of the sole assembly shown in FIG. 7A along line 12-12.
Figure 13:
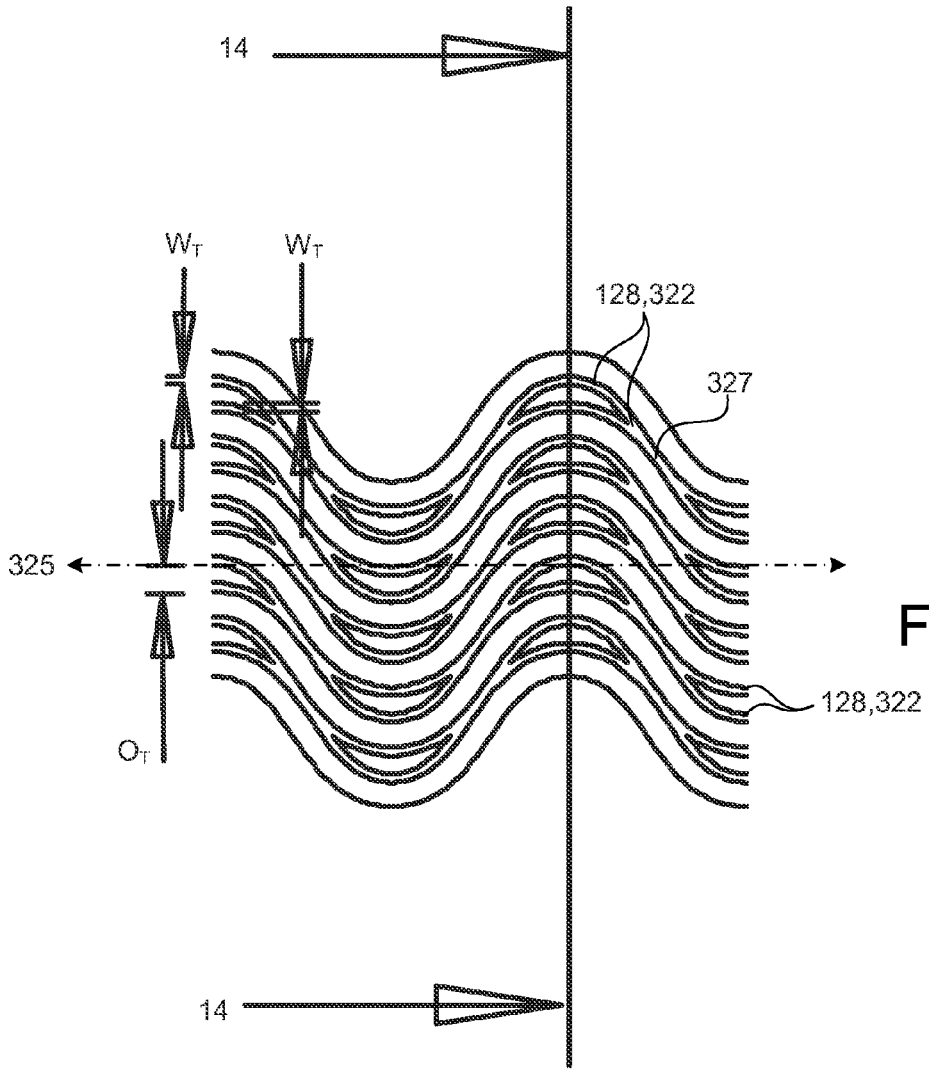
FIG. 13 is a bottom view of a portion of an exemplary outsole having sinusoidal grooves.
Figure 14:
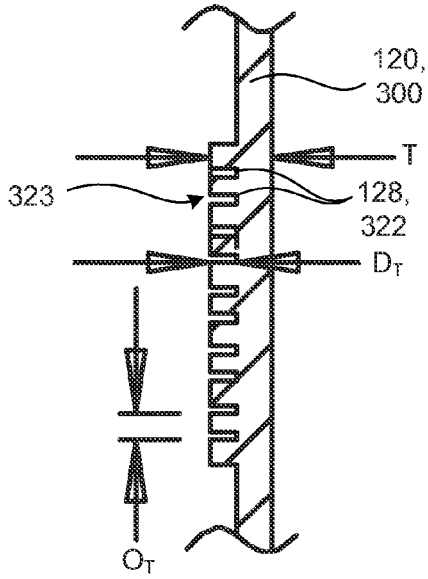
FIG. 14 is a section view of the outsole shown in FIG. 13 along line 14-14.
Figure 15:
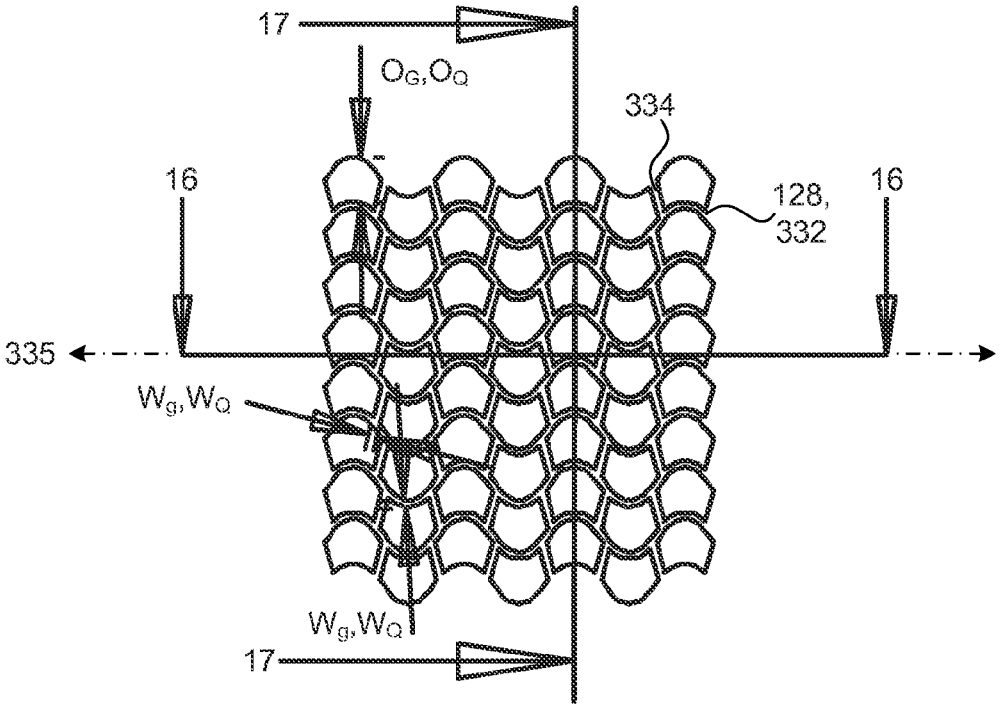
FIG. 15 is a bottom view of a portion of an exemplary outsole having sinusoidal grooves.
Figure 16:
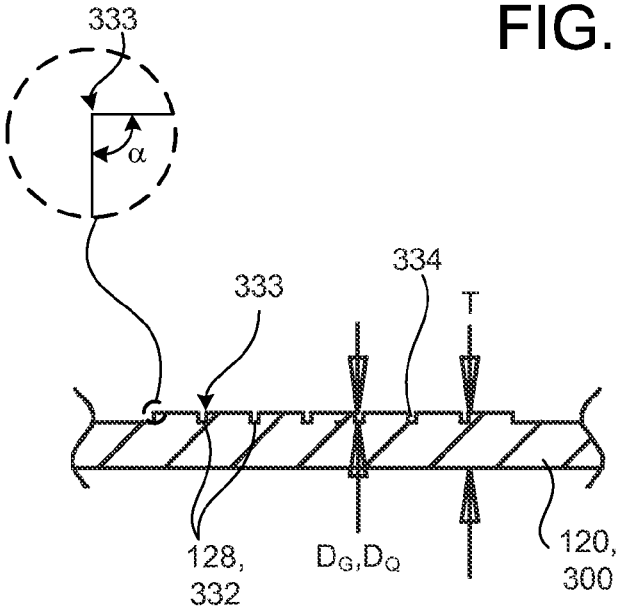
FIG. 16 is a section view of the outsole shown in FIG. 15 along line 16-16.
Figure 17:
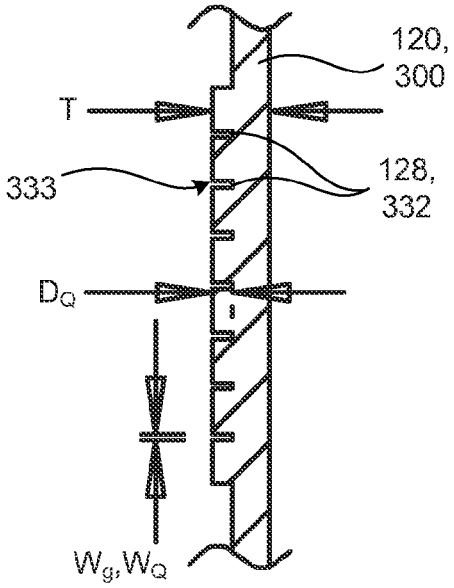
FIG. 17 is a section view of the outsole shown in FIG. 15 along line 17-17.

Referring to FIG. 6B, the second layer 120 may define a tetra-hexagonal pattern 610 of grooves 128. A first portion 600*a* of the second layer 120 may comprise a grove pattern 610 defining a hexagonal tiling pattern of figures 622. The grove pattern 610 includes interconnecting hexagonally shaped figures 622*a* having no overlaps or gaps. A second portion 600*b* of the second layer 120 may comprise a grove pattern 610 defining a rhombille and/or hexagonal tiling of figures 622*b*. A third portion 600*c* of the second layer 120 may comprise a grove pattern 610 defining a triangular tiling of figures 622*c* (e.g., equilateral triangles). Adjacent portions 600*a-c* of the second layer 120 may blend their corresponding patterns therebetween. The hexagonal figures 622*a* in the first portion 600*a* may have a relatively larger shape than the rhombi and triangular figures 622*b*, 622*c*. Moreover, the rhombi figures 622*b* may have a relatively larger shape than the triangular figures 622*c*. An arrangement of figures 622 having progressively larger sizes from the phalanges portion 101 to the heel portion 104 can allow correspondingly greater bend-ability of the second layer 120 for the relatively smaller sized figures 622 in the third portion 600*a* (e.g., along the phalanges and metatarsal portions 101, 103 of the upper 100) as compared to the relatively larger sized figures 522 in the third portion 600*c* (e.g., along an upright portion near the foot opening 105). Forming grooves 128 having relatively smaller sized figures 622 in the third portion 600*a* provides relatively greater groove density in that portion 600*a* as well.

The channels 124 and/or grooves 128 defined by the second layer 120 can be arranged to provide an edge density of between about 40 mm/cm$^2$ and about 200 mm/cm$^2$ and/or a surface contact ratio of between about 40% and about 95%. In some implementations, the channels 124 and/or grooves 128 are arranged to provide an edge density of between about 100 mm/cm$^2$ and about 110 mm/cm$^2$ and/or a surface contact ratio of between about 50% and about 95%.

Referring to FIGS. 2F and 7A-7G, in some implementations, the sole assembly 200 includes an outsole 300 connected to a midsole 400 and having aground contact surface 310. The outsole 300 has a forefoot portion 302, a heel portion 304 as well as a lateral portion 306 and a medial portion 308. The midsole 400 can be made of ethylene vinyl acetate (EVA), foam, or any suitable material for providing cushioning in an article of footwear.

The outsole 300 may have a tread configuration designed for slip resistance. For example, the ground contact surface 310 of the ° outsole 300 (FIGS. 2F and 7A) may define a plurality of grooves or channels 312, such as siped grooves or slits, that receive water escaping from between the ground contact surface 310 and the ground as the outsole 300 is pressed against the ground (e.g., when the sole assembly 200 bears the weight of a user). Liquid can flow in the grooves or channels 312 toward a perimeter of the outsole 300 (i.e., away from weight-bearing and contact surfaces). The grooves or channels 312 may also be configured to provide flex regions of the outsole 300, such as in the forefoot portion 302 to accommodate toe lifting of a user or flexing during walking or running. The grooves or channels 312 may be adequately sized for liquid movement there-through, white deterring the accumulation of small objects therein. Moreover, the grooves or channels 312 may flex open (e.g., during walking or running), providing traction and water escapement from the ground contact surface 310. In some implementations, the grooves or channels 312 are cut into the outsole 300, while in other implementations, the grooves or channels 312 are molded with the outsole 300.

The grooves or channels 312 can have a width $W_G$ of between about 0.1 mm to about 5 mm (e.g., 1.2 mm) and/or a depth $D_G$ of between about 25% to about 75% of a thickness T of the outsole 300. For example, for an outsole 300 having a thickness of 3.5 mm, the grooves 312 can have a depth $D_G$ of between about 0.8 mm and about 2.6 mm (e.g., a depth $D_G$ of 1 mm, 2 mm, or 2.5 mm). Siped grooves 312 may have a relatively thin width $W_G$ as compared to other types of grooves 312. Siped grooves 312 may be formed by razor cutting the groove 312 into the outsole 300 or molding the groove 312 with a relatively narrow width $W_G$.

In the examples shown, the outsole 300 defines first and second tread regions 320, 330; however, the outsole 300 may define one contiguous tread region or many tread regions arranged randomly or in specific locations on the ground contact surface 330. Each tread region 320, 330 includes a corresponding configuration grooves or channels 322, 332 that provides traction on wet or slippery surfaces. The groove or channel configuration can be arranged to have a certain edge density and a certain surface contact ratio to provide a certain level of traction performance (or resistance to slip). Edge dens: can be defined as a length of surface edges of the ground contact surface 310 (e.g., the cumulative length (millimeters) of edges on the ground contact surface 310 from the grooves or channels 322, 332) within a square centimeter. In general, the greater the edge density, the greater the traction; however, manufacturability, aesthetics, resistance to wear and other factors may limit the edge density. The surface contact ratio can be defined as an overall area of the ground contact surface 310 minus a groove area of the ground contact surface 310 (i.e. an area of the ground contact surface removed for the grooves or channels 322, 332) divided by the overall area of the ground contact surface 310. In dry conditions, a surface contact ratio of 100% can provide the best traction; however, a ground contact surface 310 with no grooves or channels 322, 332 provides very poor traction or slip resistance in wet conditions. Therefore, a relationship or balance between the edge density and the surface contact ratio of the ground contact surface 310 can provide certain traction and performance characteristics of the outsole 300 in various environmental conditions.

The grooves or channels 312, 322, 332 of the outsole 300 can be arranged to provide an edge density of between about 40 mm/cm$^2$ and about 200 mm/cm$^2$ and/or a surface contact ratio of between about 40% and about 95%. In some implementations, the grooves or channels 312, 322, 332 of the outsole 300 are arranged to provide an edge density of between about 100 mm/cm$^2$ and about 110 mm/cm$^2$ and/or a surface contact ratio of between about 50% and about 95%.

In some implementations, the grooves and/or channels 124, 128, 322, 332 on the second layer 120 and/or the outsole 300 defines a sinusoidal path along the corresponding contact surface 122, 310. For example, the sinusoidal path of the grooves or channels 124, 128, 322, 332 may be defined by the following equation:

$$y(t)=A\cdot\text{sine}(\omega t+\phi) \quad (1)$$

where t is time, A is amplitude, ω is angular frequency and ϕ is phase at a time of t=0. Referring to FIGS. 1, 3F, 7A-7G and 15-17, a tread pattern for the second layer 120 and/or the outsole 300 may include grooves or channels 124, 128, 312, 322, 332 having one or more of the parameters provided in Table 1. Any of the disclosure herein regarding grooves for the outsole 300 may be applied the second layer 120 and vice versa.

TABLE 1

| Parameter | Value |
|---|---|
| Edge Density | 40-200 mm/cm$^2$ |
| Surface Contact Ratio | 40%-90% |
| Amplitude (A) of Sinusoidal Path | 3 mm-25 mm |
| Frequency (ω) of Sinusoidal Path | 4 mm-50 mm |
| Groove Offset ($O_G$) | 2 mm-5 mm |
| Groove Width ($W_G$) | 0.1 mm-5 mm |
| Groove Depth ($D_G$) | 25-75% of outsole thickness |
| Groove Edge Angle (α) | 75°-150° |
| Outsole Compound Durometer | 45-65 Shore A |

Referring to FIGS. 13-17, in some examples, the sinusoidal path of a groove 128, 322, 332 has an amplitude and frequency that provides a substantially symmetric shape (e.g., a one-to-one ratio). Adjacent wave grooves or channels 128, 322, 332 can be arranged as close as possible, providing a relatively high edge density. Moreover, a width $W_T$, $W_Q$ of the grooves or channels 128, 322, 332 can be maintained as small as possible (e.g., via razor siping) to provide a relatively large surface contact ratio of the contact surface 122, 310. In some examples, the grooves or channels 128, 322 can each have a width $W_T$, $W_Q$ of between about 0.1 mm and about 1 mm 0.5 mm) and a depth $D_T$, $D_Q$ of between about 25% and about 75% of a thickness T of the outsole 300. For example, for a second layer 120 and/or an outsole 300 having a thickness of 3.5 mm, the grooves or channels 128, 322, 332 can have a depth $D_T$, $D_Q$ of between about 0.8 mm and about 2.6 mm (e.g., a depth D of 1 mm, 1.5 mm, 2 mm, or 2.5 mm).

Referring to FIGS. 3F and 7A-17, in some implementations, the first and second tread regions 320, 332 define grooves or channels 322, 332 in wave configurations (e.g., sine waves). In the example shown in FIGS. 8-12, the grooves or channels 322, 332 can each define a corresponding shoulder 323, 333 (FIGS. 13-17) that defines aright angle or substantially at right angle (e.g., a non-radiused, non-chamfered corner or a minimally radiused corner for mold release). Other shoulder configurations are possible as well. The right angle edge style shoulder 323, 333 provides a traction edge for slip resistance. A sharp corner edge provides relatively better traction over a rounded corner, since the sharp edge can catch on surface features of the ground. As the outsole 300 flexes, each shoulder or edge 323, 333 can grab the ground for traction. Each shoulder or edge 323, 333 within a square centimeter can be counted for determining the edge density of that corresponding region of the outsole 300.

Referring to FIGS. 3F, 7A, 13 and 14, in some implementations, the first tread region 320 defines grooves or channels 322 propagating in a wave pattern with an axis of propagation 325 (FIG. 13) substantially parallel to a longitudinal axis 301 of the outsole 300. The first tread region 320 provides traction for lateral movements of the outsole 300 against the ground, such as side-to-side movements by a user. The groove or channel arrangement places a relatively longer leading edge 323 of each groove or channel 322 perpendicular to a direction of slip, thus providing slip resistance against forces substantially parallel to a transverse axis 303 of the outsole 300. In the example shown, the outsole 300 includes a lateral first tread region 320*a* and a medial first tread region 320*b* disposed on corresponding lateral and medial portions 306, 308 of the outsole 300. The lateral first tread region 320*a* can be arranged near a lateral perimeter 306*a* of the outsole 300 and the medial first tread region 320*b* can be arranged near a medial perimeter 308*a* of the outsole 300. The second tread region 330 can be arranged between the lateral first tread region 320*a* and the medial first tread region 320*b* in at least a ground striking portion 307 of the outsole 300 (e.g., substantially under the heel and metatarsal of a user's foot). As a user moves side-to-side, weight can be placed on the respective lateral and medial potions 306, 308 of the outsole 300. The respective lateral and medial first tread regions 320*a*, 320*b* can provide traction or slip resistance against forces incurred by the ground contact surface 310 along the transverse axis 303 of the outsole 300. The outsole 300 can have thickness T of about 3.5 mm in the first tread region 320.

In some examples, each groove or channel 128, 322 follows a sinusoidal path with an amplitude of about 8.8 mm (or 8.8 mm+/−1 or 2 mm) and an angular frequency of about 20 mm (or 20 mm+/−3 mm). Each grove or channel 128, 322 can have a width $W_T$ of about 0.5 mm and/or a depth $D_T$ of about 1.5 mm. In some implementations, the axis of propagation 325 of each grove or channel 128, 322 is offset from the axis of propagation 325 of an adjacent grove or channel 128, 322 by an offset distance $O_T$ of between about 1 mm and about 2 mm. Adjacent grooves or channels 128, 322 can be arranged such that their corresponding groove paths merge at various or periodic groove intersections 327. The first tread region 320 my have an edge density of groove edges 323 of about 124 min/cm$^2$ and a surface contact ratio of about 65%.

Referring to FIGS. 3F, 7A and 15-17, in some implementations, the second tread region 330 defines grooves 332 propagating in a wave pattern with an axis of propagation 335 (FIG. 15) substantially parallel to the transverse axis 303 of the outsole 300. The second tread region 330 provides traction for forward and rearward movements of the outsole 300 against the ground along a walking direction of the user. The groove arrangement places a relatively longer leading edge 323 of each groove 322 perpendicular to a direction of slip, thus providing slip resistance against forces on the ground contact surface 310 substantially parallel to the longitudinal axis 301 of the outsole 300 (as during walking or running along a normal walking direction (forward or reverse)). The outsole 300 can have thickness T of about 4 mm in the second tread region 330.

In some examples, each grooves 128, 332 follows a sinusoidal path with an amplitude of 5 mm (or 5 mm+/−1 or 2 mm) and an angular frequency of 6.3 mm (or 6.3 mm+/−1 or 2 mm). Each grove 128, 332 can have a width $W_Q$ of about 0.4 mm, a depth $D_Q$ of about 1.2 mm. In some implementations, the axis of propagation 335 of each grove 128, 332 is offset from the axis of propagation 335 of an adjacent grove 128, 332 by an offset distance $O_Q$ of between about 1.5 mm and about 3.5 mm (e.g., about 2.75 mm). Moreover, branch or cross-linking grooves 334 can interconnect adjacent grooves 128, 332 (e.g., every quarter or half a wavelength of the sinusoidal grooves 332). In some examples, the branch grooves 334 extend in a direction substantially parallel to or at a relatively small angle (e.g., between about 1° and about 45°) with respect to the longitudinal axis 301. The branch grooves 334 may have a width $W_Q$ of about 0.4 mm, a depth $D_Q$ of about 0.6 mm (or about half the depth $D_Q$ of the other grooves 332). The second tread region 330 may have an edge density of groove edges 333 of about 106 mm/cm$^2$ and a surface contact ratio of about 91%.

Figure 18A:
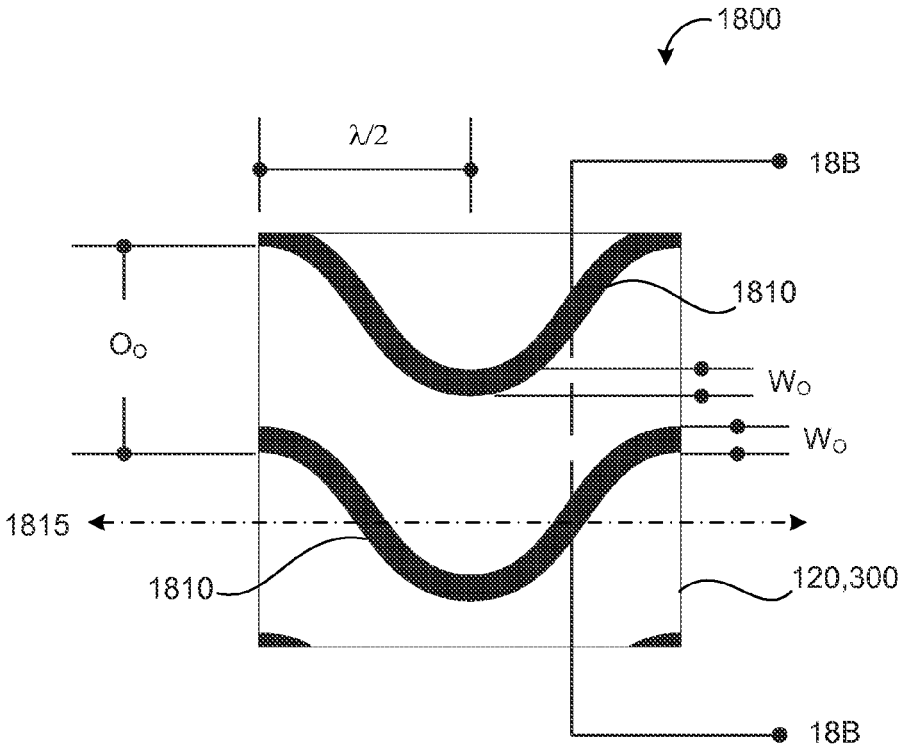
FIG. 18A is a bottom view of a portion of an exemplary outsole having sinusoidal grooves.
Figure 18B:
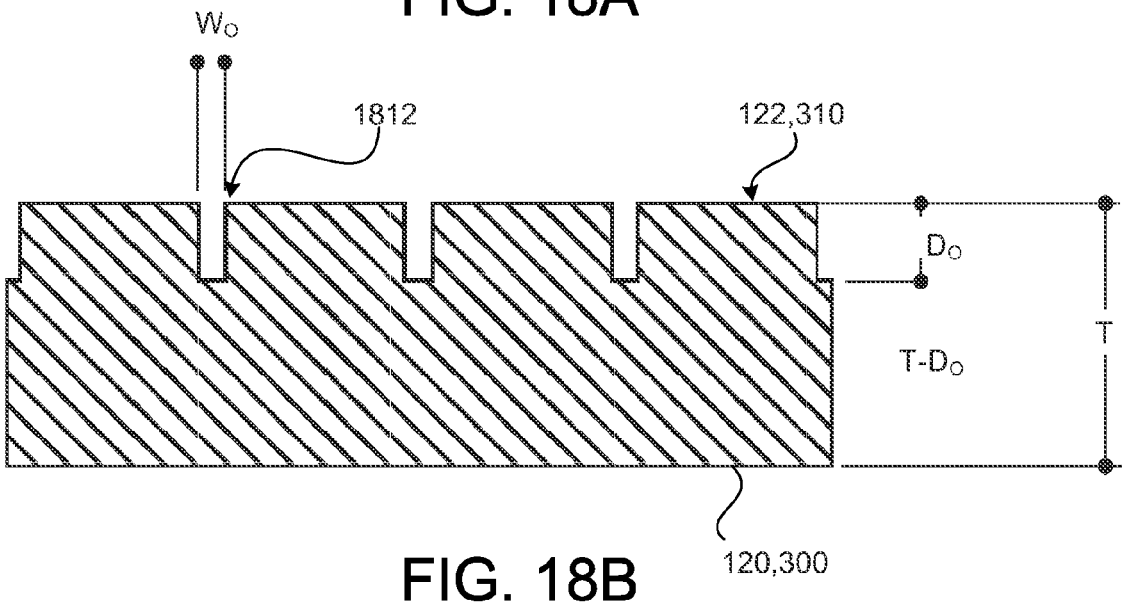
FIG. 18B is a section view of the outsole shown in FIG. 18A along line 18B-18B.

FIGS. 18A-22B depict a number of tread patterns for the second layer 120 and/or the outsole 300, FIGS. 18A and 18B illustrate a first tread pattern 1800 for the outsole 300 that includes grooves 1810 having a sinusoidal path along the contact surface 122, 310 and equally spaced parallel to each other in a common direction. Each groove 1810 may have an amplitude A of about 5 mm, a frequency ω of about 6.3 mm, a width $W_O$ of about 0.4 mm, and/or a depth $D_O$ of about 1.2 mm. Moreover, the groove 1810 can have a wavelength λ of about 6.3 mm. Each groove 1810 can be formed or cut to have a shoulder 1813 that defines right angle or substantially a right angle (e.g., non-radiused, non-chamfered corner or a minimally radiused corner for mold release). The right angle edge style shoulder 1812 provides a traction edge for slip resistance. A sharp corner edge provides relatively better traction over a rounded corner. An axis of propagation 1815 of each groove 1810 can be offset from the axis of propagation 1815 of an adjacent groove 1810 by an offset distance $O_O$ of about 3.15 mm. With respect to the outsole 300, the outsole 300 may have a thickness T of about 4 mm. The first tread pattern 1800 may have an edge density (e.g., of shoulder edges 1812) of about 79.5 min/cm$^2$ and a surface contact ratio of about 84%.

Figure 19A:
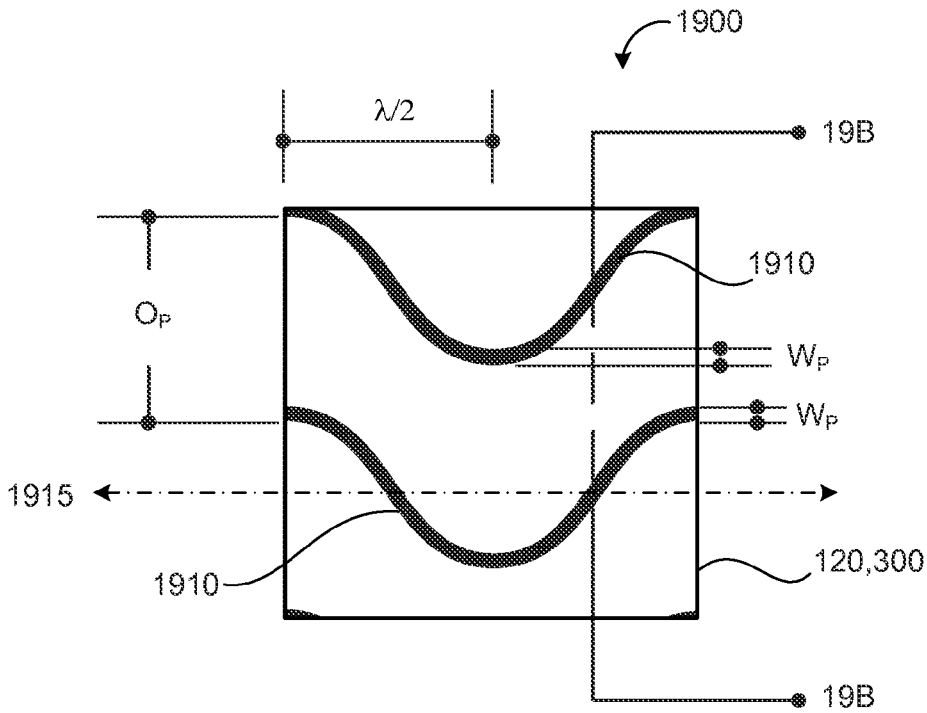
FIG. 19A is a bottom view of a portion of an exemplary outsole having sinusoidal grooves.
Figure 19B:
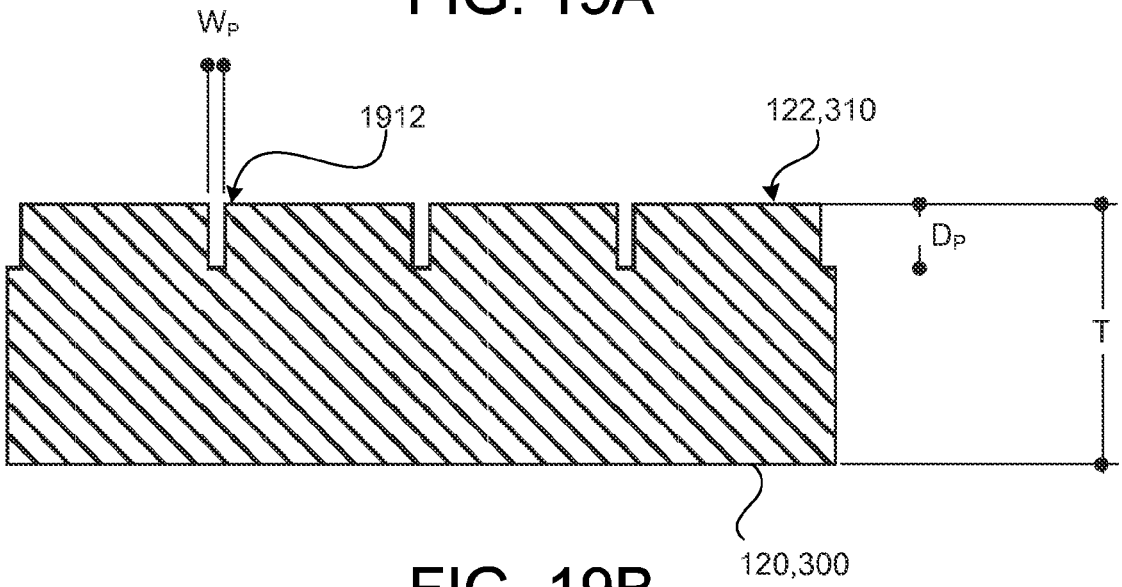
FIG. 19B is a section view of the outsole shown in FIG. 19A along line 19B-19B.

FIGS. 19A and 19B illustrate a second tread pattern 1900 for the second layer 120 and/or the outsole 300 that includes grooves 1910 having a sinusoidal path along the contact surface 122, 310 and equally spaced parallel to each other in a common direction. Each groove 1910 may have an amplitude A of about 5.25 mm, a frequency ω of about 6.3 mm, a width $W_P$ of about 0.25 mm, and/or a depth $D_P$ of about 1.2 mm. Moreover, the groove 1910 can have a wavelength λ of about 6.3 mm. Each groove 1910 can be formed or cut to have a shoulder 1912 that defines right angle or substantially a right angle (e.g., a non-radiused, non-chamfered corner or a minimally radiused corner for mold release). An axis of propagation 1915 of each groove 1910 can be offset from the axis of propagation 1915 of an adjacent groove 1910 by an offset distance $O_P$ of about 3 mm. With respect to the outsole 300, the outsole 300 may have a thickness T of about 4 mm. The second tread pattern 1900 may have an edge density (e.g., of shoulder edges 1912) of about 77 mm/cm$^2$ and a surface contact ratio of about 90.5%.

Figure 20A:
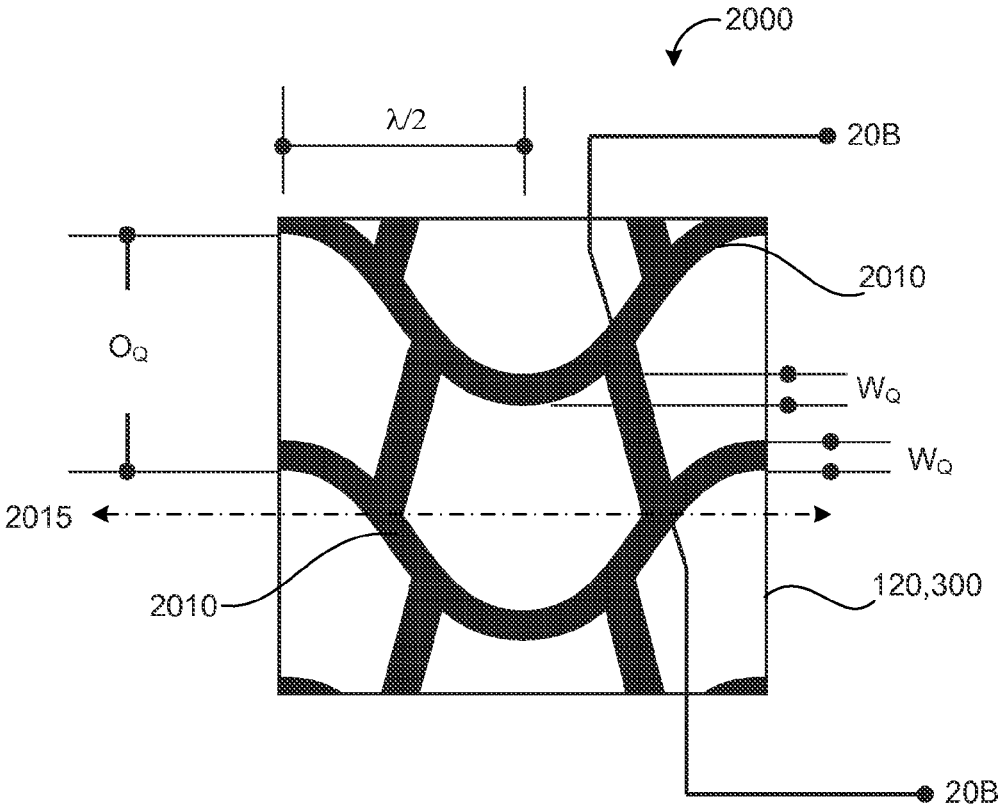
FIG. 20A is a bottom view of a portion of an exemplary outsole having sinusoidal grooves.
Figure 20B:
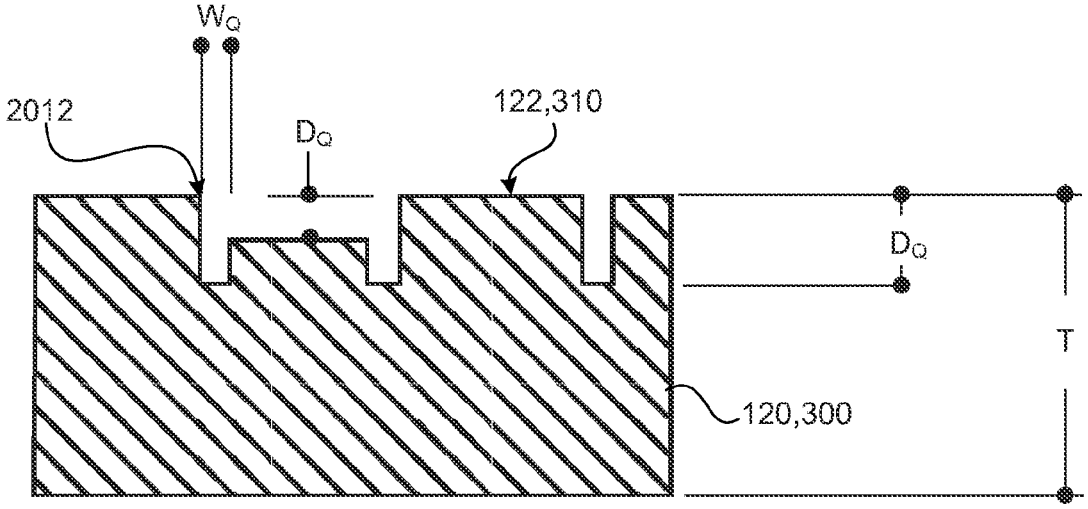
FIG. 20B is a section view of the outsole shown in FIG. 20A along line 20B-20B.

FIGS. 20A and 20B illustrate a third tread pattern 2000 for the second layer 120 and/or the outsole 300 that includes grooves 2010 having a sinusoidal path along the contact surface 122, 310 and equally spaced parallel to each other in a common direction. Each groove 2010 may have an amplitude A of about 5 mm, frequency ω of about 6.3 mm, a width $W_Q$ of about 0.4 min, and/or a depth $D_Q$ of about 1.2 mm. Moreover, the groove 2010 can have a wavelength λ of about 6.3 mm. Each groove 2010 can be formed or cut to have a shoulder 2012 that defines right angle or substantially a right angle (e.g., a non-radiused, non-chamfered corner or a minimally radiused corner for mold release). An axis of propagation 2015 of each groove 1910 can be offset from the axis of propagation 2015 of an adjacent groove 2010 by an offset distance $O_Q$ of about 3.15 mm. With respect to the outsole 300, the outsole 300 may have a thickness T about 0.4 mm. Cross-linking grooves 1014 connecting adjacent grooves 1812 may have a width $W_Q$ of about 0.4 mm, and a depth $D_Q$ of about 0.6 mm. The third tread pattern 2000 may have an edge density (e.g. of shoulder edges 2012) of about 106 mm/cm$^2$ and a surface contact ratio of about 91%.

Figure 21A:
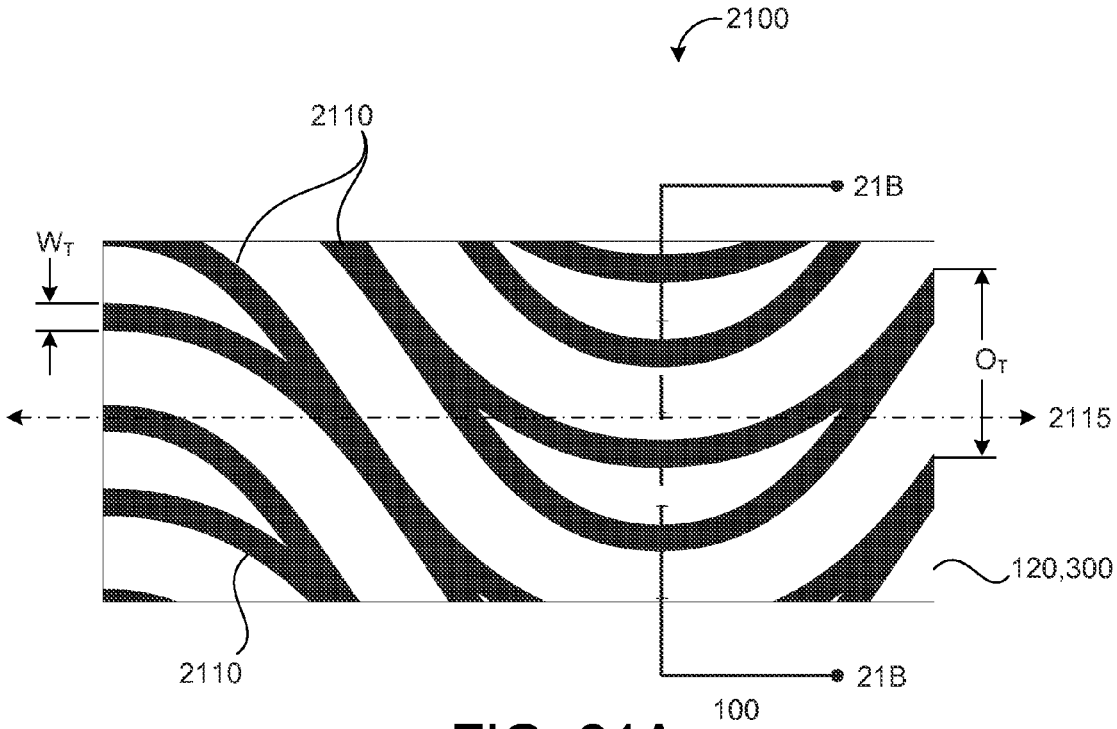
FIG. 21A is a bottom view of a portion of an exemplary outsole having sinusoidal grooves.
Figure 21B:
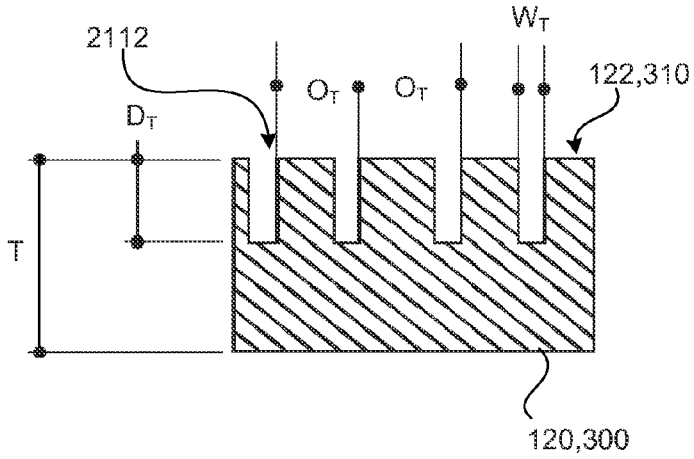
FIG. 21B is a section view of the outsole shown in FIG. 21A along line 21B-21B.

FIGS. 21A and 21B illustrate a fourth tread pattern 2100 for the second layer 120 and/or the outsole 300 that includes grooves 2110 having a sinusoidal path along the contact surface 122, 310 and equally spaced parallel to each other in a common direction. Each groove 2110 may have an amplitude A of about 17.6 mm, a frequency ω of about 40 mm, a width $W_T$ of about 1 mm, and/or a depth $D_T$ of about 1.5 mm. Moreover, the groove 2110 can have a wavelength λ of about 20 mm. Each groove 2110 can be formed or cut to have a shoulder 2112 that defines right angle or substantially a right angle (e.g., non-radiused, non-chamfered corner or a minimally radiused corner for mold release). An axis of propagation 2115 of each groove 2110 can be offset from the axis of propagation 2115 of an adjacent groove 2110 by an offset distance $O_T$ of between about 3 mm and about 3.75 mm. In the example, for three consecutive grooves 2110, a first groove 2110 is offset from a second groove 2110 by an offset distance $O_T$ of about 3 mm, and the second groove 2110 is offset from a third groove 2110 by an offset distance $O_T$ of about 3.75 mm. With respect to the outsole, the outsole 300 may have a thickness T of about 3.5 mm. The fourth tread pattern 2100 may have an edge density (e.g., of shoulder edges 2112) of about 59 mm/cm$^2$ and a surface contact ratio of about 67%.

Figure 22A:
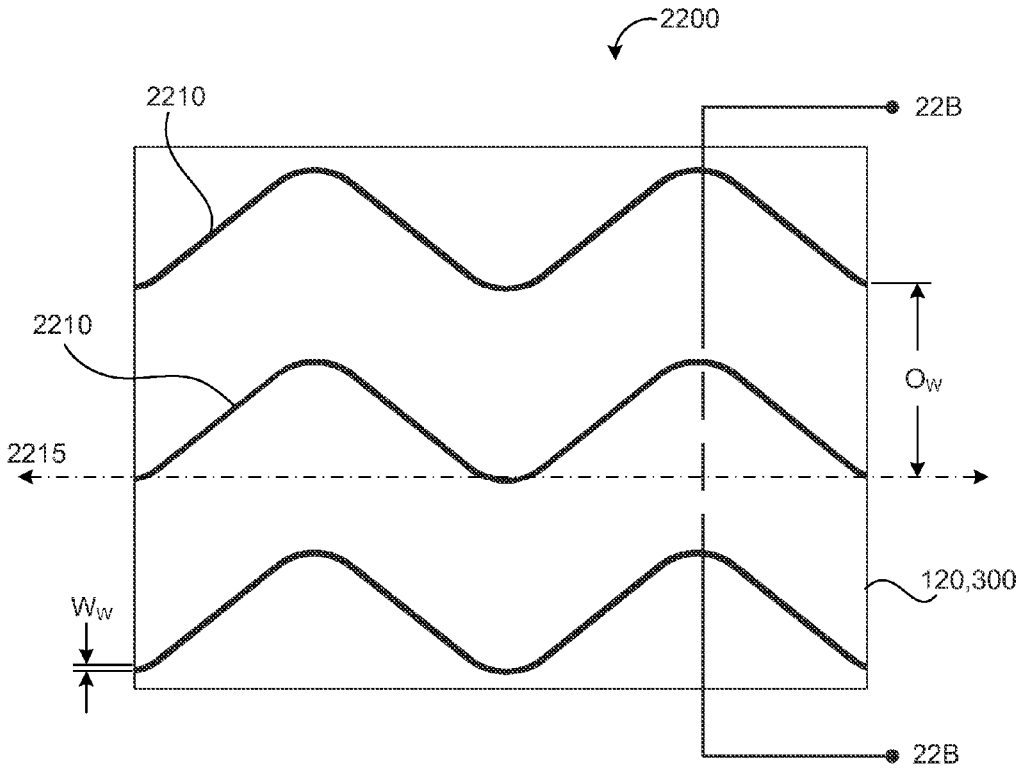
FIG. 22A is a bottom view of a portion of an exemplary outsole having sinusoidal or zig-zag style grooves.
Figure 22B:
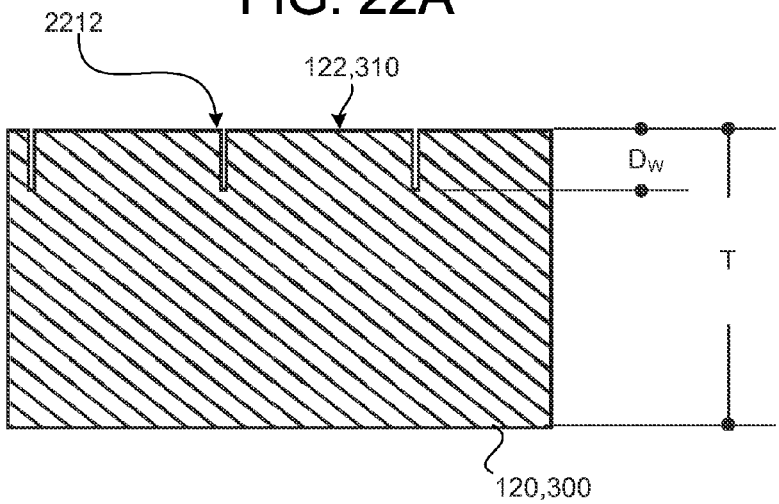
FIG. 22B is a section view of the outsole shown in FIG. 22A along line 22B-22B.

FIGS. 22A and 22B illustrate a fifth tread pattern 2200 for the second layer 120 and/or the outsole 300 that includes razor siping or grooves 2210 having a sinusoidal or zig-zag path along the contact surface 122, 310 and equally spaced parallel to each other in a common direction. Each groove 2210 may have an amplitude A of about 5.12 mm, a frequency ω of about 6.5 mm, a width $W_W$ of about between 0 mm and about 0.25 mm, and/or a depth $D_W$ of about 1.2 mm. Moreover, each groove 2210 can be cut to have a shoulder 2212 that defines right angle or substantially a right angle (e.g., a non-radiused, non-chamfered corner). An axis of propagation 2215 of each groove 2210 can be offset from the axis of propagation 2215 of an adjacent groove 2210 by an offset distance $O_P$ of about 5.12 mm. With respect to the outsole 300, the outsole 300 may have a thickness T of about 5 mm. The fifth tread pattern 2200 may have an edge density (e.g., of shoulder edges 2212) of about 98 mm/cm$^2$ and a surface contact ratio of about 98%.

Anti-slip characteristics of the second layer 120 and/or the outsole 300 may depend on the contact surface configuration (e.g., tread pattern, edge density, and/or surface contact ratio) as well as the material of the second layer 120 or outsole 300, respectively. The second layer 120 and/or the outsole 300 may be comprised of one or more materials. In some examples, the outsole comprises at least one of natural rubber, rubber, 0.9 anti-slip rubber (rubber having a minimum coefficient of friction of 0.9 for a durometer of 50-55 Shore A), and 1.1 anti-slip rubber (rubber having a minimum coefficient of friction of 1.1 for a durometer 50-55 Shore A), and latex, each having a durometer of between about 50 Shore A and about 65 Shore A.

A slip resistance test can be performed to determine a slip index or slip angle for different combinations of tread configurations and outsole materials to select a tread configuration and outsole material appropriate for a particular application, such as boating, fishing, or activities on wet surfaces. The slip resistance test can be performed using a tribometer (also known as a slipmeter), which is an instrument that measures a degree of friction between two rubbing surfaces. The English XL Variable Incidence Tribometer (VII) (available from Excel Tribometers, LLC, 160 Tymberbrook Drive, Lyman, S.C. 29365) is an exemplary Tribometer for determining slip resistance for various outsole configurations. The VII instrument mimics biomechanical parameters of the human walking gait and replicates a heel strike of a human walking (e.g., using a leg and ankle device). A leg of the VII instrument is free to accelerate once a slip occurs, as with a real-world human slip event. For example, some testing instruments that drag across the floor at a constant rate do not account for what happens when humans slip and fall. Moreover, the phenomenon of "sticktion" may produce misleading results when a Table 2 provides results of slip resistance tests conducted on a number of materials having the same surface configuration in wet and dry conditions in accordance with ASTM D1894 measuring a coefficient of friction between a smooth sample material (i.e., flat without treads) and a metal surface.

TABLE 2

| Material | Durometer (Shore A) | Slip Index Dry | Slip Index Wet |
|---|---|---|---|
| First Rubber | 50-55 | 1.06 | 1.08 |
| Second Rubber | 60-65 | 0.96 | 0.85 |
| 0.9 Anti-Slip Rubber | 50-55 | 1.16 | 1.03 |
| 0.9 Anti-Slip Rubber | 60-65 | 0.74 | 0.70 |
| 1.1 Anti-Slip Rubber | 50-55 | 1.57 | 1.52 |
| Third Rubber | 60-65 | 0.93 | 0.68 |
| Latex | 60-65 | 1.37 | 1.27 |

Table 3 provides results of slip resistance tests conducted on a number of materials having the same surface configuration in wet and dry conditions in accordance with ASTM F1679-04 using a Variable Incidence Tribometer (VIT). A slip angle is the determined between a sample material and a test surface (e.g., a textured surface, Teak wood, Polyester-fiberglass, or metal). The sample material defined grooves having the third tread pattern (Q) 2000 described herein with reference to FIGS. 20A and 20B. Textured polyester fiberglass was used as the test surface for the results shown in Table 3.

TABLE 3

| Material | Durometer (Shore A) | Dry Slip Angle (Deg.) | Wet Slip Angle (Deg.) |
|---|---|---|---|
| First Rubber | 50-55 | 46 | 46 |
| Second Rubber | 60-65 | 39 | — |
| 0.9 Anti-Slip Rubber | 50-55 | 54 | 53 |
| 0.9 Anti-Slip Rubber | 60-65 | 43 | 42 |
| 1.1 Anti-Slip Rubber | 50-55 | 56 | 57 |
| 1.1 Anti-Slip Rubber | 60-65 | 46 | 47 |
| Third Rubber | 60-65 | 45 | 42 |
| Latex | 50-55 | 47 | 47 |
| Latex | 60-65 | 55 | 38 |

Table 4 provides results of slip resistance tests conducted on a number of materials having the same surface configuration in wet and dry conditions in accordance with ASTM F1679-04 using a Variable Incidence Tribometer (VIT). The sample material defined grooves having the fourth tread pattern (T) 2100 described herein with reference to FIGS. 21A and 21B. Textured polyester fiberglass was used as the test surface for the results shown in Table 4.

TABLE 4

| Material | Durometer (Shore A) | Dry Slip Angle (Deg.) | Wet Slip Angle (Deg.) |
|---|---|---|---|
| First Rubber | 50-55 | 47 | 42 |
| Second Rubber | 60-65 | 37 | — |
| 0.9 Anti-Slip Rubber | 50-55 | 54 | 52 |
| 0.9 Anti-Slip Rubber | 60-65 | 48 | 46 |
| 1.1 Anti-Slip Rubber | 50-55 | 55 | 56 |
| 1.1 Anti-Slip Rubber | 60-65 | 46 | 48 |
| Third Rubber | 60-65 | 38 | 35 |
| Latex | 50-55 | 45 | 46 |
| Latex | 60-65 | 58 | 40 |

The slip resistance test results shown in Tables 2-4 reveal that the 1.1 Anti-Slip Rubber having a durometer of 50-55 Shore A out-performed the other samples, while latex having a durometer of 60-65 Shore A and the 0.9 Anti-Slip Rubber having a durometer of 50-55 Shore A performed relatively well in comparison to the remaining samples as well The selection of an outsole material for an outsole 300 may depend on the combined performance of the material type and a tread configuration of the outsole 300.

Table 5 provides results of slip resistance tests for different combinations of tread designs and outsole materials on Teak wood under 20 psi of pressure. A sixth sample is smooth with no treads as a control sample.

TABLE 5

| Tread Pattern | Material | Durometer (Shore A) | VIT Slip Test Angle (°) Dry | VIT Slip Test Angle (°) Wet |
|---|---|---|---|---|
| First tread pattern 1800 (O) | 0.9 Anti-Slip Rubber | 50-55 | 44 | 42 |
| | Latex | 50-55 | 40 | 39 |
| | Latex | 60-65 | 40 | 40 |
| Second tread pattern 1900 (P) | 0.9 Anti-Slip Rubber | 50-55 | 45 | 68 |
| | Latex | 50-55 | 37 | 33 |
| | Latex | 60-65 | — | — |
| Third tread pattern 2000 (Q) | 0.9 Anti-Slip Rubber | 50-55 | 41 | 43 |
| | Latex | 50-55 | 42 | 41 |
| | Latex | 60-65 | — | — |
| Fourth tread pattern 2100 (T) | 0.9 Anti-Slip Rubber | 50-55 | 43 | 42 |
| | Latex | 50-55 | 40 | 40 |
| | Latex | 60-65 | 43 | 41 |
| Fifth tread pattern 2200 (W) | 0.9 Anti-Slip Rubber | 50-55 | 44 | 14 |
| | Latex | 50-55 | 40 | 37 |
| | Latex | 60-65 | — | — |
| Smooth (no treads) (AA) | 0.9 Anti-Slip Rubber | 50-55 | 47 | 43 |
| | Latex | 50-55 | 43 | 7 |
| | Latex | 60-65 | 50 | 25 |

Figure 23A:
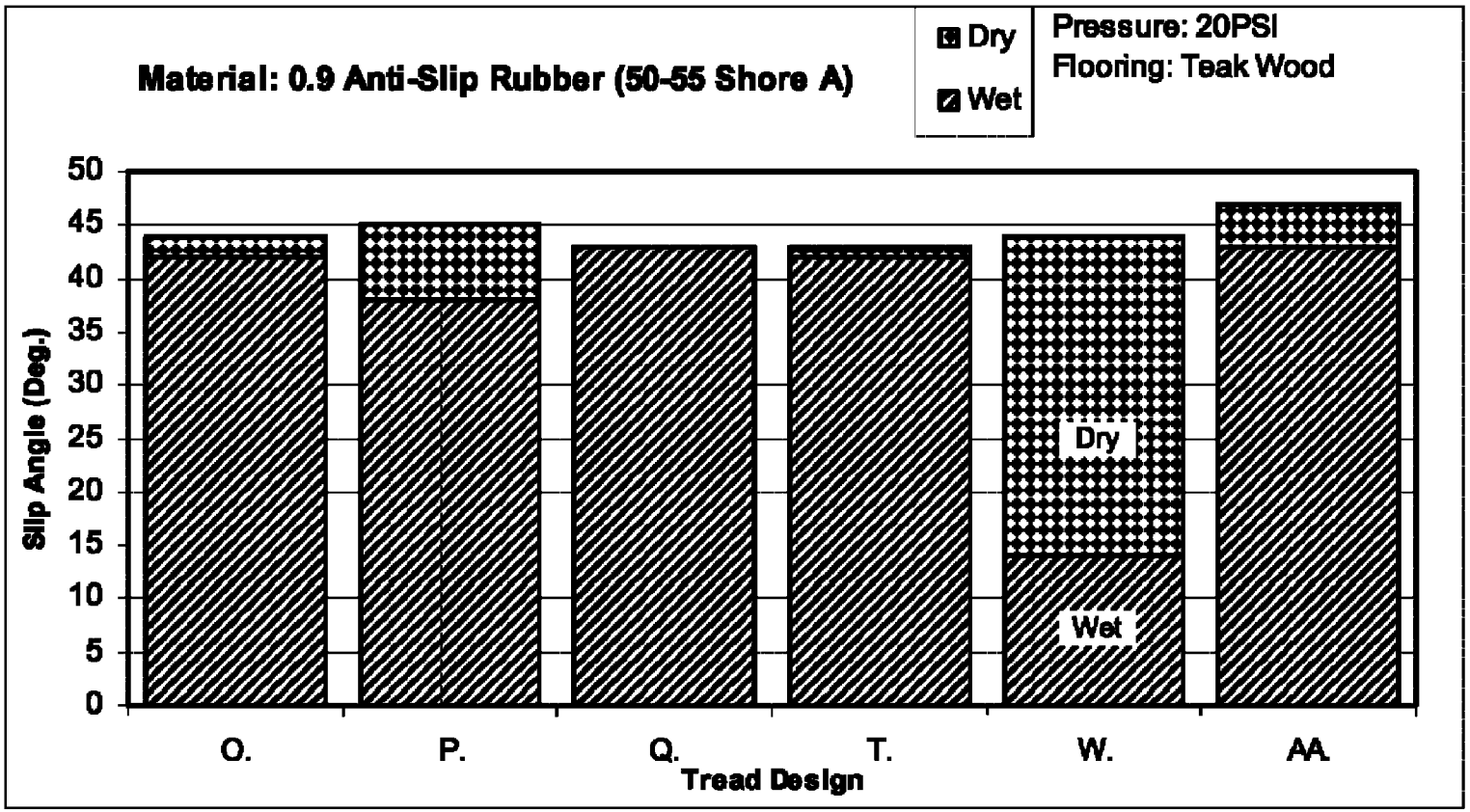
FIG. 23A is a chart of slip test resistance results under wet and dry conditions for various tread configurations of an outsole comprising a rubber having a coefficient of friction of 0.9 and a durometer of 50-55 Shore A.
Figure 23B:
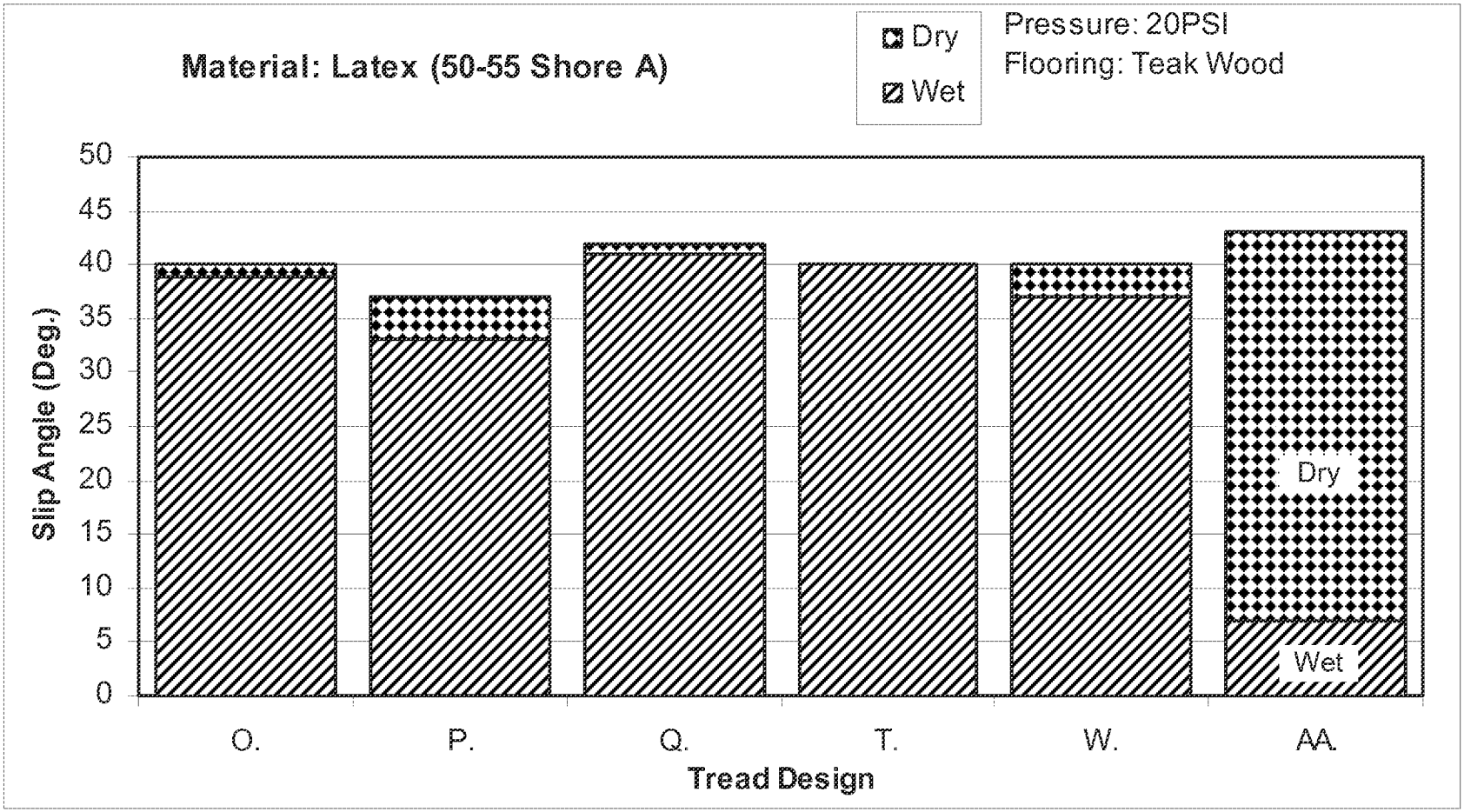
FIG. 23B is a chart of slip test resistance results under wet and dry conditions for various tread configurations of an outsole comprising latex having a durometer of 50-55 Shore A.
Figure 23C:
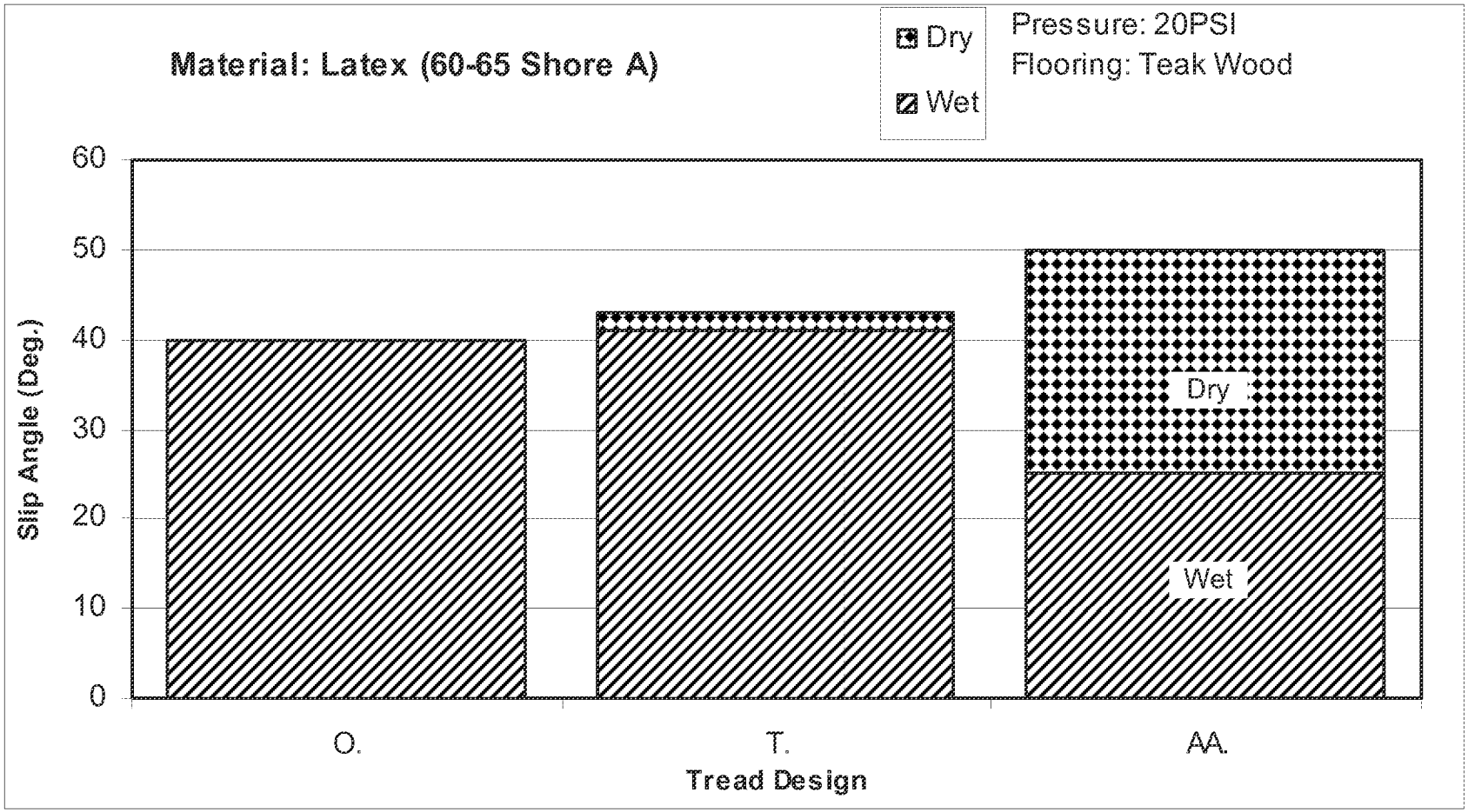
FIG. 23C is a chart of slip test resistance results under wet and dry conditions for various tread configurations of an outsole comprising latex having a durometer of 60-65 Shore A.

FIGS. 23A-23C provide three graphs of the results shown in Table 5 separated by material type. The third and fourth tread patterns (Q, T) 2000, 2100 each perform substantially equally between wet and dry conditions, in addition to providing relatively high slip resistance.

Table 6 provides results of slip resistance tests for different combinations of tread designs and outsole materials on Teak wood under 25 psi of pressure. A sixth sample is smooth with no treads as a control sample.

TABLE 6

| Tread Pattern | Material | Durometer (Shore A) | VIT Slip Test Angle (°) Dry | VIT Slip Test Angle (°) Wet |
|---|---|---|---|---|
| First tread pattern 1800 (O) | 0.9 Anti-Slip Rubber | 50-55 | 47 | 43 |
| | Latex | 50-55 | 40 | 39 |
| | Latex | 60-65 | 40 | 40 |
| Second tread pattern 1900 (P) | 0.9 Anti-Slip Rubber | 50-55 | 45 | 36 |
| | Latex | 50-55 | 37 | 33 |
| | Latex | 60-65 | — | — |
| Third tread pattern 2000 (Q) | 0.9 Anti-Slip Rubber | 50-55 | 47 | 45 |
| | Latex | 50-55 | 42 | 41 |
| | Latex | 60-65 | — | — |
| Fourth tread pattern 2100 (T) | 0.9 Anti-Slip Rubber | 50-55 | 44 | 43 |
| | Latex | 50-55 | 40 | 40 |
| | Latex | 60-65 | 43 | 41 |
| Fifth tread pattern 2200 (W) | 0.9 Anti-Slip Rubber | 50-55 | 48 | 29 |
| | Latex | 50-55 | 40 | 37 |
| | Latex | 60-65 | — | — |
| Smooth (no treads) (AA) | 0.9 Anti-Slip Rubber | 50-55 | 53 | 15 |
| | Latex | 50-55 | 43 | 7 |
| | Latex | 60-65 | 50 | 25 |

Figure 24A:
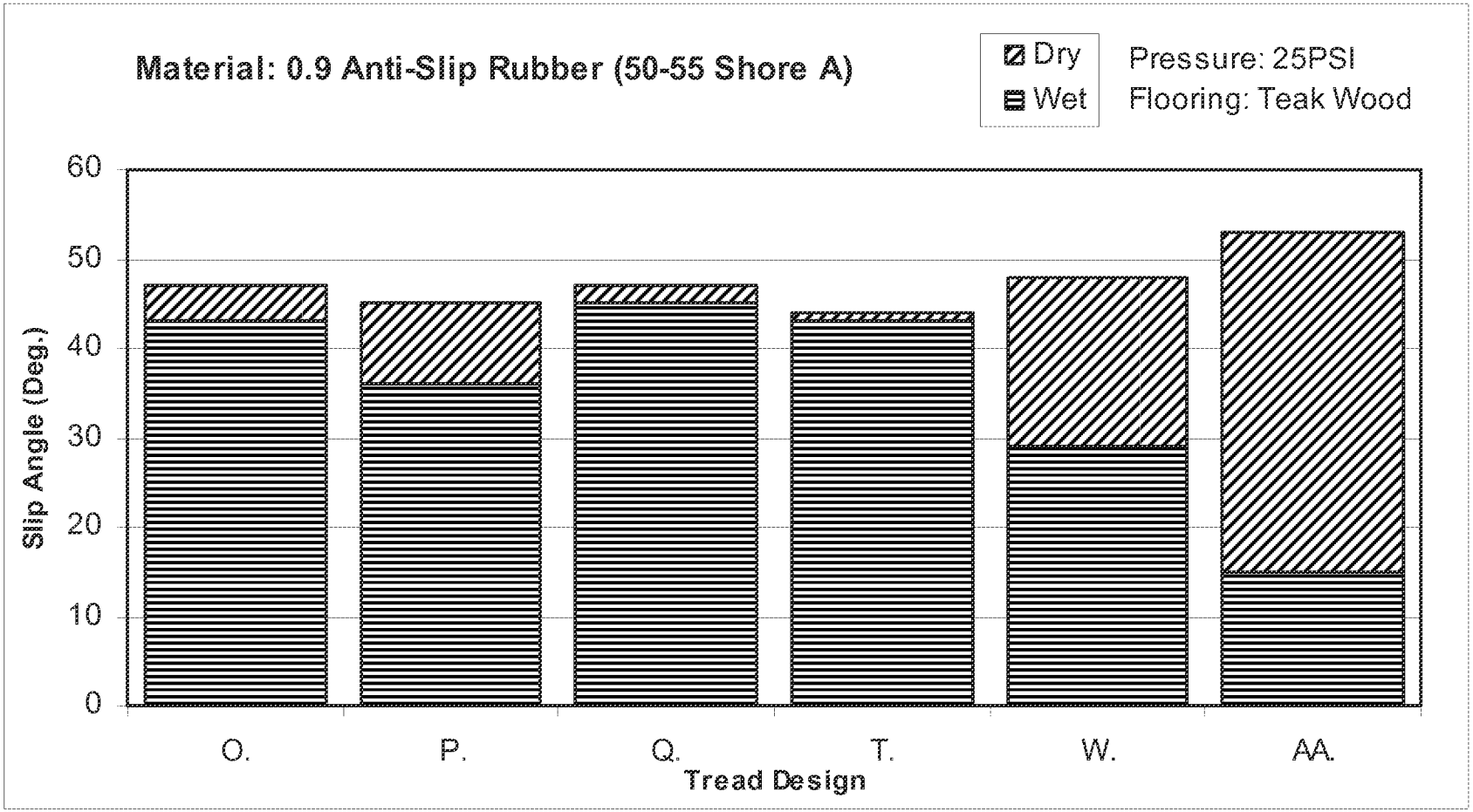
FIG. 24A is a chart of slip test resistance results under wet and dry conditions for various tread configurations of an outsole comprising a rubber having a coefficient of friction of 0.9 and a durometer of 50-55 Shore A.
Figure 24B:
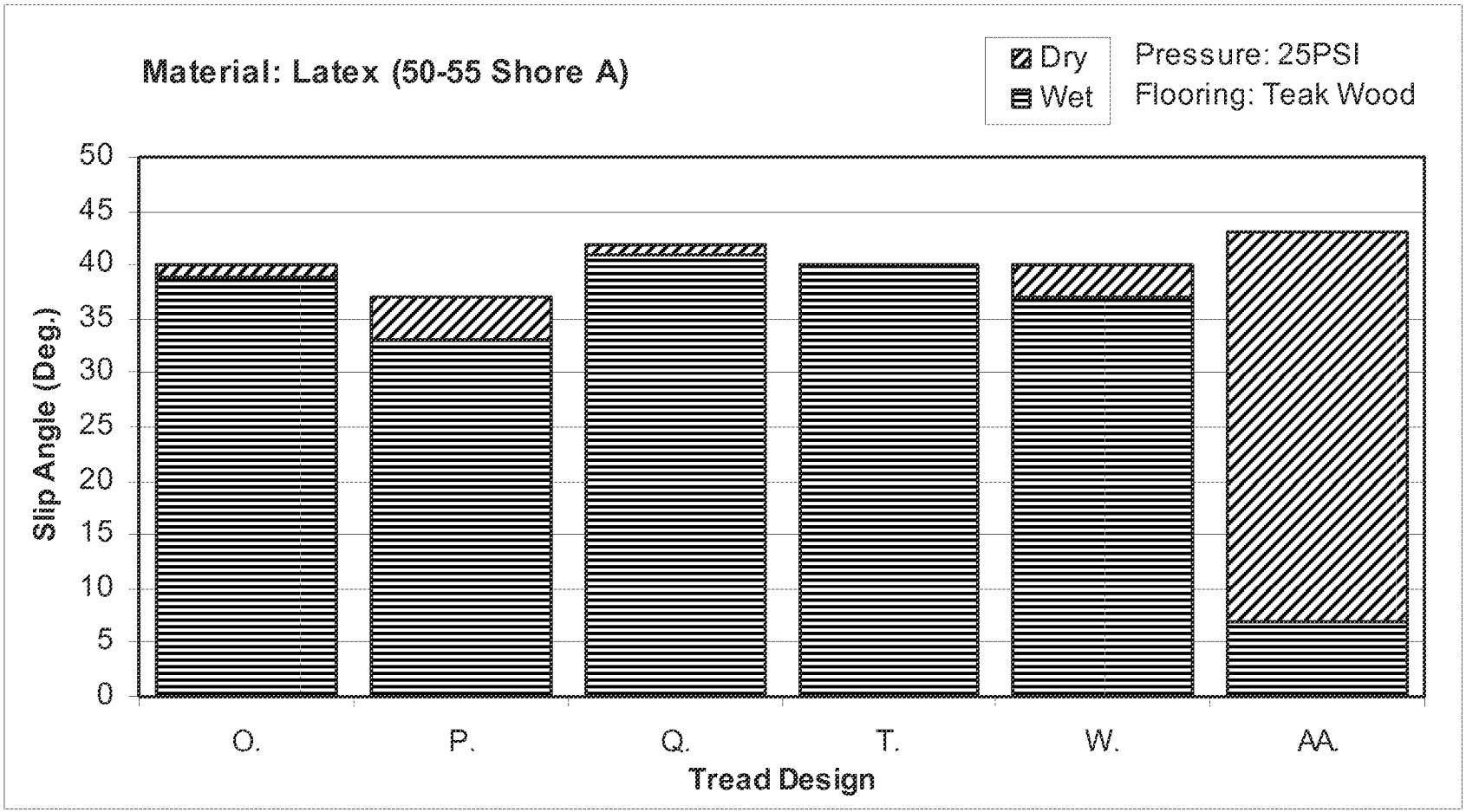
FIG. 24B is a chart of slip test resistance results under wet and dry conditions for various tread configurations of an outsole comprising latex having a durometer of 50-55 Shore A.
Figure 24C:
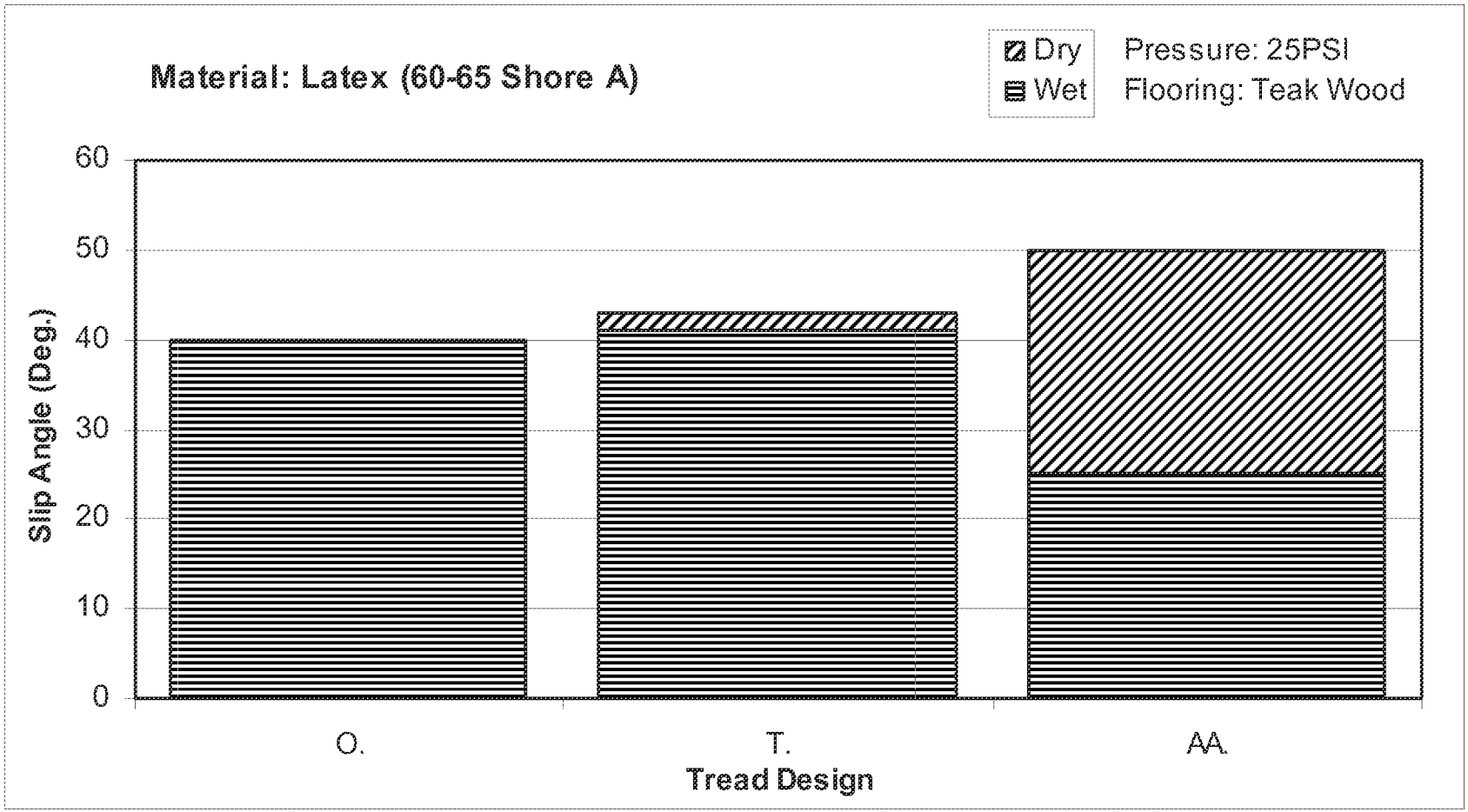
FIG. 24C is a chart of slip test resistance results under wet and dry conditions for various tread configurations of an outsole comprising latex having a durometer of 60-65 Shore A.

FIGS. 24A-24C provide three graphs of the results shown in Table 6 separated by material type. The third and fourth tread patterns (Q, T) 2000, 2100 each perform substantially equally between wet and dry conditions, in addition to providing relatively high slip resistance.

Table 7 provides results of slip resistance tests for different tread designs made of the 0.9 anti-slip rubber having durometer of 50-55 Shore A on Teak wood under 25 psi of pressure with a VIT instrument angle of 15°. A sixth sample is smooth with no treads as a control sample.

TABLE 7

| Tread Pattern | VIT Slip Test Angle (°) Dry | VIT Slip Test Angle (°) Wet |
|---|---|---|
| First tread pattern 1800 (O) | 47 | 43 |
| Second tread pattern 1900 (P) | 45 | 36 |
| Third tread pattern 2000 (Q) | 47 | 45 |
| Fourth tread pattern 2100 (T) | 44 | 43 |
| Fifth tread pattern 2200 (W) | 48 | 29 |
| Smooth (no treads) (AA) | 53 | 15 |

Table 8 provides results of slip resistance tests for different tread designs made of the 1 anti-slip rubber having durometer of 50-55 Shore A on Teak wood under 25 psi of pressure with a VIT instrument angle of 15°. A sixth sample is smooth with no treads as a control sample.

TABLE 8

| Tread Pattern | VIT Slip Test Angle (°) Dry | Wet |
|---|---|---|
| First tread pattern 1800 (O) | 61 | 54 |
| Second tread pattern 1900 (P) | 59 | 54 |
| Third tread pattern 2000 (Q) | 61 | 56 |
| Fourth tread pattern 2100 (T) | 57 | 53 |
| Fifth tread pattern 2200 (W) | 57 | 15 |
| Smooth (no treads) (AA) | 61 | 15 |

Table 9 provides results of slip resistance tests for different tread designs made of the 1.1 anti-slip rubber having durometer of 50-55 Shore A on textured polyester fiberglass under 25 psi of pressure with a VIT instrument angle of 15°. A sixth sample is smooth with no treads as a control sample.

TABLE 9

| Tread Pattern | VIT Slip Test Angle (°) Dry | Wet |
|---|---|---|
| First tread pattern 1800 (O) | 58 | 52 |
| Second tread pattern 1900 (P) | 59 | 55 |
| Third tread pattern 2000 (Q) | 61 | 55 |
| Fourth tread pattern 2100 (T) | 56 | 52 |
| Fifth tread pattern 2200 (W) | 57 | 15 |
| Smooth (no treads) (AA) | 61 | 15 |

A number of implementations have been described. Nevertheless, it will be understood that various modifications may be made without departing from the spirit and scope of the disclosure. Accordingly, other implementations are within the scope of the following claims.

What is claimed is:

1. A footwear upper comprising:

a first layer formed of a resilient, waterproof or at least water resistant material, the first layer encircling the ankle of a wearer; and a second layer disposed on the first layer exteriorly of the first layer, the second layer having a contact surface, the second layer defining grooves in a rhombille tiling pattern;

wherein each groove is substantially rectangular in cross-section and has at least one corner edge, the corner edge is adjacent the contact surface and defines a right angle to form a substantially non-radiused corner that is adapted to catch on a surface feature and provide traction between the footwear upper and the surface feature;

wherein the grooves are adequately sized to allow water escapement from between the contact surface and the surface feature through the grooves.

2. The footwear upper of claim 1, wherein the second layer is disposed on at least one of a top forefoot portion, a heel portion, a lateral portion, and a medial portion of the first layer.

3. The footwear upper of claim 1, wherein the rhombille tiling comprises a tessellation of 60° rhombi.

4. The footwear upper of claim 1, wherein the rhombille tiling pattern comprises a hexagonal tiling of overlapping hexagonally shaped figures, each figure being divided into three rhombi meeting at a center point of the hexagonally shaped figure.

5. The footwear upper of claim 4, wherein first and second diagonals of each rhombus have a ratio of 1:3.

6. The footwear upper of claim 1, wherein the grooves are defined to provide an edge density of between about 40 $mm/cm^2$ and about 200 $mm/cm^2$ and a surface contact ratio of between about 40% and about 95%.

7. The footwear upper of claim 1, wherein the first layer comprises polychloroprene.

8. The footwear upper of claim 1, wherein the second layer comprises rubber.

9. The footwear upper of claim 1, wherein the second layer has durometer of between about 35 Shore A and about 70 Shore A.

10. The footwear upper of claim 1, wherein the second layer has a thickness of between about 1 mm and about 1.5 cm.

11. A footwear article comprising:

a sole assembly; and an upper assembly attached to the sole assembly, the upper assembly forming a water bootie and comprising:

a first layer formed of a resilient, waterproof or at least water resistant material, the first layer encircling the ankle of a wearer; and a second layer disposed on the first layer exteriorly of the first layer, the second layer having a contact surface, the second layer defining grooves in a rhombille tiling pattern;

wherein each groove is substantially rectangular in cross-section and has at least one corner edge, the corner edge being adjacent the contact surface and defining a right angle to form a substantially non-radiused corner that is adapted to catch on a surface feature and provide traction between the footwear upper and the surface feature;

wherein the grooves are adequately sized to allow water escapement from between the contact surface and the surface feature through the grooves.

12. The footwear article of claim 11, wherein the second layer is disposed on at least one of a top forefoot portion, a heel portion, a lateral portion, and a medial portion of the first layer.

13. The footwear article of claim 11, wherein the rhombille tiling comprises a tessellation of 60° rhombi.

14. The footwear article of claim 11, wherein the rhombille tiling comprises a hexagonal tiling of overlapping hexagonally shaped figures, each figure being divided into three rhombi meeting at a center point of the hexagonally shaped figure.

15. The footwear article of claim 14, wherein first and second diagonals of each rhombus have a ratio of 1:3.

16. The footwear article of claim 11, wherein the grooves are defined to provide an edge density of between about 40 $mm/cm^2$ and about 200 $mm/cm^2$ and a surface contact ratio of between about 40% and about 95%.

17. The footwear article of claim 11, wherein the first layer comprises polychloroprene.

18. The footwear article of claim 11, wherein the second layer comprises rubber.

19. The footwear article of claim 11, wherein the second layer has durometer of between about 35 Shore A and about 70 Shore A.

20. The footwear article of claim 11, wherein the second layer has a thickness of between about 1 mm and about 1.5 cm.

21. The footwear article of claim 11, further comprising a third layer disposed between the first and second layers, the third layer comprising a compliant material for cushioning.

22. The footwear article of claim 11, wherein the sole assembly comprises an outsole body having a ground contact surface and defining outsole grooves having a sinusoidal path along the ground contact surface, the outsole grooves being arranged to provide an edge density of between about 40 mm/cm$^2$ and about 200 mm/cm$^2$ and a surface contact ratio of between about 40% and about 95%.

23. The footwear article of claim 22, wherein at least one sinusoidal outsole groove path along the ground contact surface has an amplitude of between about 3 mm and about 25 mm and/or a frequency of between about 4 mm and about 50 mm.

24. The footwear article of claim 23, wherein the corresponding outsole groove of the at least one sinusoidal groove path has a width of about 0.4 mm.

25. The footwear article of claim 23, wherein the corresponding outsole groove of the at least one sinusoidal groove path has a depth of about 1.2 mm.

26. The footwear article of claim 22, wherein each outsole groove has at least one shoulder with the ground contact surface, the at least one shoulder defining a right angle with a substantially non-radiused corner.

27. The footwear article of claim 11, wherein the sole assembly comprises an outsole body having a ground contact surface and defining outsole grooves having a sinusoidal path along the ground contact surface, the outsole grooves defining a sinusoidal groove path along the ground contact surface having an amplitude of about 5 mm and a frequency of about 6.3 mm.

28. The footwear article of claim 27, wherein the outsole grooves have at least one of a width of about 0.4 mm and a depth of about 1.2 mm.

29. The footwear article of claim 27, wherein adjacent outsole grooves are offset from each other along the ground contact surface in a common direction by an offset distance of about 3.15 mm.

30. The footwear article of claim 27, further comprising at least one channel connecting adjacent outsole grooves.

31. The footwear article of claim 27, wherein the outsole grooves are arranged substantially parallel to each other to provide an edge density of about 106 min/cm$^2$ and a surface contact ratio of about 91%.

32. The footwear article of claim 11, wherein the sole assembly comprises an outsole body having aground contact surface and defining outsole grooves having a sinusoidal path along the ground contact surface, the grooves defining a sinusoidal groove path along the ground contact surface having an amplitude of about 17.6 mm and a frequency of about 40 mm.

33. The footwear article of claim 32, wherein the outsole grooves have at least one of a width of about 1 mm and a depth of about 1.5 mm.

34. The footwear article of claim 33, wherein adjacent outsole grooves are offset from each other along the ground contact surface in a common direction by an offset distance of between about 3 mm and about 3.75 mm.

35. The footwear article of claim 34, wherein for three consecutive outsole grooves along the ground contact surface, a first groove is offset from a second groove by an offset distance of about 3 mm and the second groove is offset from a third groove by an offset distance of about 3.75 mm.

36. The footwear article of claim 32, wherein at least some adjacent outsole grooves intersect each other periodically along their respective sinusoidal paths.

37. The footwear article of claim 32, wherein the outsole grooves are arranged substantially parallel to each other to provide an edge density of about 59 mm/cm$^2$ and a surface contact ratio of about 67%.

38. The footwear article of claim 11, wherein the sole assembly comprises an outsole body comprising at least one of rubber having a durometer of between about 45 Shore A and about 65 Shore A, a rubber having a minimum coefficient of friction of about 0.9 and a durometer of between about 50 Shore A and about 65 Shore A, and a rubber having a minimum coefficient of friction of about 1.1 and a durometer of between about 50 Shore A and about 65 Shore A.

39. The footwear article of claim 11, wherein the sole assembly comprises an outsole body having lateral and medial portions and a ground contact surface, the outsole body defining a longitudinal axis along a walking direction and perpendicular transverse axis, the ground contact surface having a first tread region disposed on the lateral outsole body portion near a lateral periphery of the outsole, a second tread region disposed on the medial outsole body portion near a medial periphery of the outsole, and a third tread region disposed between the first and second tread regions in at least a ground striking portion of the outsole;

wherein the first and second tread regions define outsole grooves having a sinusoidal path along the ground contact surface with an axis of propagation substantially parallel to the longitudinal axis of the outsole body, adjacent outsole grooves offset from each other along the transverse axis by a first offset distance; and wherein the third tread region defines outsole grooves having a sinusoidal path along the ground contact surface with an axis of propagation substantially parallel to the transverse axis of the outsole body, adjacent outsole grooves offset from each other along the longitudinal axis by a second offset distance.

40. The footwear article of claim 39, wherein the outsole grooves of the first and second tread regions define a sinusoidal groove path along the ground contact surface having an amplitude of about 17.6 mm and a frequency of about 40 mm.

41. The footwear article of claim 40, wherein the outsole grooves of the first and second tread regions have at least one of a width of about 1 mm and a depth of about 1.5 mm.

42. The footwear article of claim 39, wherein the first offset distance is between about 3 mm and about 3.75 mm and the second offset distance is about 3.15 mm.

43. The footwear article of claim 42, wherein for three consecutive outsole grooves along the ground contact surface of the first and second tread regions, a first outsole groove is offset from a second outsole groove by an offset distance of about 3 mm and the second outsole groove is offset from a third outsole groove by an offset distance of about 3.75 mm.

44. The footwear article of claim 39, wherein the outsole grooves of the first and second tread regions are arranged to provide an edge density of about 59 mm/cm$^2$ and a surface contact ratio of about 67%.

45. The footwear article of claim 39, wherein the outsole grooves of the third tread region define a sinusoidal groove path along the ground contact surface having an amplitude of about 5 mm and a frequency of about 6.3 mm.

46. The footwear article of claim 45, wherein the outsole grooves of the third tread region have at least one of a width of about 0.4 mm and a depth of about 1.2 mm.

47. The footwear article of claim 39, wherein the third tread region further comprise at least one channel connecting adjacent outsole grooves.

48. The footwear article of claim 47, wherein the at least one channel has a depth of about half a depth of the outsole grooves of the third tread region.

49. The footwear article of claim 47, wherein the at least one channel has a width substantially equal to a width of the outsole grooves the third tread region.

50. The footwear article of claim 39, wherein the outsole grooves of the third tread region are arranged to provide an edge density of about 106 mm/cm$^2$ and a surface contact ratio of about 91%.

51. A footwear upper comprising:

a first layer formed of a resilient, waterproof or at least water resistant material, the first layer encircling the ankle of a wearer; and a second layer disposed on the first layer exteriorly of the first layer, the second layer defining grooves arranged to have edge density of between about 40 mm/cm$^2$ and about 200 min/cm$^2$ and a surface contact ratio of between about 40% and about 95%, each groove is substantially rectangular in cross-section and has a width of between about 0.1 mm and about 2.5 mm so as to allow water escapement through each groove;

wherein the grooves are defined to have a sinusoidal path along an axis of propagation extending laterally across a width of the upper, and each groove has at least one corner edge, the at least one corner edge defining a right angle to form a substantially non-radiused corner that is adapted to catch on a surface feature and provide traction between the footwear upper and the surface feature.

52. The footwear upper of claim 51, wherein the second layer is disposed on at least one of a top forefoot portion, a heel portion, a lateral portion, and a medial portion of the first layer.

53. The footwear upper of claim 51, wherein at least some of the grooves merge periodically along their respective sinusoidal paths.

54. The footwear upper of claim 51, wherein at least one sinusoidal groove path has an amplitude of between about 3 mm and about 25 mm and/or a frequency of between about 4 mm and about 50 mm.

55. The footwear upper of claim 54, wherein the at least one sinusoidal groove path has an amplitude of about 5 mm and a frequency of about 6.3 mm.

56. The footwear upper of claim 54, wherein the at least one sinusoidal groove path has an amplitude of about 17.6 mm and a frequency of about 40 mm.

* * * * *